US010478665B1

(12) United States Patent
Daly et al.

(10) Patent No.: US 10,478,665 B1
(45) Date of Patent: Nov. 19, 2019

(54) EXERCISE APPARATUSES HAVING TREAD MEMBERS FOR SUPPORTING STRIDING EXERCISES

(71) Applicant: Brunswick Corporation, Lake Forest, IL (US)

(72) Inventors: Juliette C. Daly, Arlington Heights, IL (US); John M. Rogus, Northbrook, IL (US); Cory H. Lazar, Chicago, IL (US)

(73) Assignee: Life Fitness, LLC, Rosemont, IL (US)

( * ) Notice: Subject to any disclaimer, the term of this patent is extended or adjusted under 35 U.S.C. 154(b) by 98 days.

(21) Appl. No.: 15/693,724

(22) Filed: Sep. 1, 2017

(51) Int. Cl.

| | |
|---|---|
| ***A63B 22/00*** | (2006.01) |
| ***A63B 21/00*** | (2006.01) |
| ***A63B 22/06*** | (2006.01) |
| ***A63B 23/035*** | (2006.01) |

(52) U.S. Cl.
CPC ..... *A63B 22/0046* (2013.01); *A63B 21/4034* (2015.10); *A63B 21/4035* (2015.10); *A63B 22/001* (2013.01); *A63B 22/0664* (2013.01); *A63B 23/03575* (2013.01); *A63B 2022/0682* (2013.01); *A63B 2209/00* (2013.01)

(58) Field of Classification Search
CPC ..... A63B 22/0046; A63B 23/03575; A63B 21/4035; A63B 21/4034; A63B 22/001; A63B 22/0664; A63B 2209/00; A63B 2022/0682
See application file for complete search history.

(56) References Cited

U.S. PATENT DOCUMENTS

| | | | | |
|---|---|---|---|---|
| 2,641,249 | A * | 6/1953 | Brockman | A61H 1/0214 482/57 |
| 3,917,261 | A * | 11/1975 | Small | A61H 1/0266 482/79 |
| 4,376,532 | A * | 3/1983 | Hunstad | A63B 69/18 482/146 |
| 4,587,960 | A * | 5/1986 | Schotten | A61H 1/0214 482/57 |
| 4,786,050 | A * | 11/1988 | Geschwender | A63B 22/001 482/57 |
| 4,915,375 | A * | 4/1990 | Ginsburg | A63B 22/0605 280/294 |
| 5,411,454 | A * | 5/1995 | Chang | A61H 7/00 482/148 |
| 5,624,356 | A * | 4/1997 | Roberts | A63B 22/0046 482/57 |
| 5,928,113 | A * | 7/1999 | Roberts | A63B 22/0046 482/57 |
| 6,610,382 | B1 * | 8/2003 | Kobe | A63B 49/08 428/119 |
| 7,803,089 | B2 * | 9/2010 | Roimicher | B62M 3/08 482/51 |
| 7,878,949 | B2 * | 2/2011 | Chen | A63B 21/0552 482/52 |

(Continued)

*Primary Examiner* — Garrett K Atkinson
(74) *Attorney, Agent, or Firm* — Andrus Intellectual Property Law, LLP

(57) ABSTRACT

An exercise apparatus has a frame and first and second pedals that are coupled to the frame such that a user standing on the first and second pedals can perform a striding exercise. The first and second pedals each have a tread member that supports the bottom of a user's foot in a manner that encourages movement of the user's foot relative to the tread member during the striding exercise.

34 Claims, 15 Drawing Sheets

(56) References Cited

U.S. PATENT DOCUMENTS

| | | | | |
|---|---|---|---|---|
| 7,918,766 | B2 * | 4/2011 | Lu | A63B 22/001 482/51 |
| 7,931,566 | B1 * | 4/2011 | Radke | A63B 21/015 482/51 |
| 8,540,609 | B2 * | 9/2013 | Anderson | A63B 21/154 482/52 |
| 9,126,078 | B2 * | 9/2015 | Anderson | A63B 22/0664 |
| 9,283,425 | B2 * | 3/2016 | Lu | A63B 21/154 |
| 2009/0291809 | A1 * | 11/2009 | Chen | A63B 21/0552 482/52 |

* cited by examiner

EXERCISE APPARATUSES HAVING TREAD MEMBERS FOR SUPPORTING STRIDING EXERCISES

FIELD

The present disclosure relates to exercise apparatuses and particularly to exercise apparatuses having pedals for supporting a striding exercise.

BACKGROUND

The following U.S. Patents are incorporated herein by reference in entirety.

U.S. Pat. No. 9,283,425 discloses an exercise assembly having a frame and elongated foot pedal members that are each movable along user-defined paths of differing dimensions. Each foot pedal member has a front portion and a rear portion. Footpads are disposed on the rear portion. Elongated coupler arms have a lower portion and an upper portion that is pivotally connected to the frame. Crank members have a first portion that is pivotally connected to the front portion of one of the pair of foot pedal members and have a second portion that is pivotally connected to the lower portion of one of the pair of coupler arms, such that each crank member is rotatable in a circular path. Elongated rocker arms have a lower portion that is pivotally connected to one of the pair of foot pedal members in between the foot pad and the crank member and have an upper portion that is pivotally connected to the frame.

U.S. Pat. No. 9,126,078 discloses an elliptical step exercise apparatus having a dynamic link mechanism that can be used to vary the stride length of the machine. A control system can also be used to vary stride length as a function of various exercise and operating parameters such as speed and direction as well as varying stride length as a part of a preprogrammed exercise routine such as a hill or interval training program. In addition the control system can use measurements of stride length to optimize operation of the apparatus.

U.S. Pat. No. 8,540,609 discloses an exercise apparatus that simulates climbing and includes such features as arm handles that move in synchronism with the motion of foot pedals to provide a total body workout; side handrails; a mounting step; linear foot movement at a simulated climbing angle; a three point support structure using a vertical support column; pedal track covers; a mechanism to provide constant resistance to pedal motion; and pedal impact absorption.

U.S. Pat. No. 7,931,566 discloses an exercise apparatus, which may be an elliptical cross trainer, has a rotating inertial flywheel driven by user-engaged linkage exercising a user. A user-actuated brake engages and stops rotation of the flywheel upon actuation by the user.

U.S. Pat. No. 7,918,766 discloses an exercise apparatus for providing elliptical foot motion that utilizes a pair of rocking links suspended from an upper portion of the apparatus frame permitting at least limited arcuate motion of the lower portions of the links. Foot pedal assemblies are connected to rotating shafts or members located on the lower portion of the links such that the foot pedals will describe a generally elliptical path in response to user foot motion on the pedals.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

An exercise apparatus has a frame and first and second pedals that are coupled to the frame such that a user standing on the first and second pedals can perform a striding exercise. The first and second pedals each have a tread member that supports the bottom of a user's foot in a manner that encourages movement of the user's foot relative to the tread member during the striding exercise. The tread member extends longitudinally from front to back along a longitudinal axis, laterally from left side to right side along a lateral axis that is perpendicular to the longitudinal axis, and vertically from bottom to top along a vertical axis that is perpendicular to the longitudinal axis and perpendicular to the lateral axis. In examples, the tread member has a contoured upper tread surface that is convex or concave with respect to the longitudinal axis and thus facilitates a rolling motion of the bottom of the user's foot relative to the tread member so that a change in angle occurs between the user's foot and the base of the pedal during the striding exercise. Several additional examples are disclosed herein.

DETAILED DESCRIPTION OF THE DRAWINGS

Figure 1:
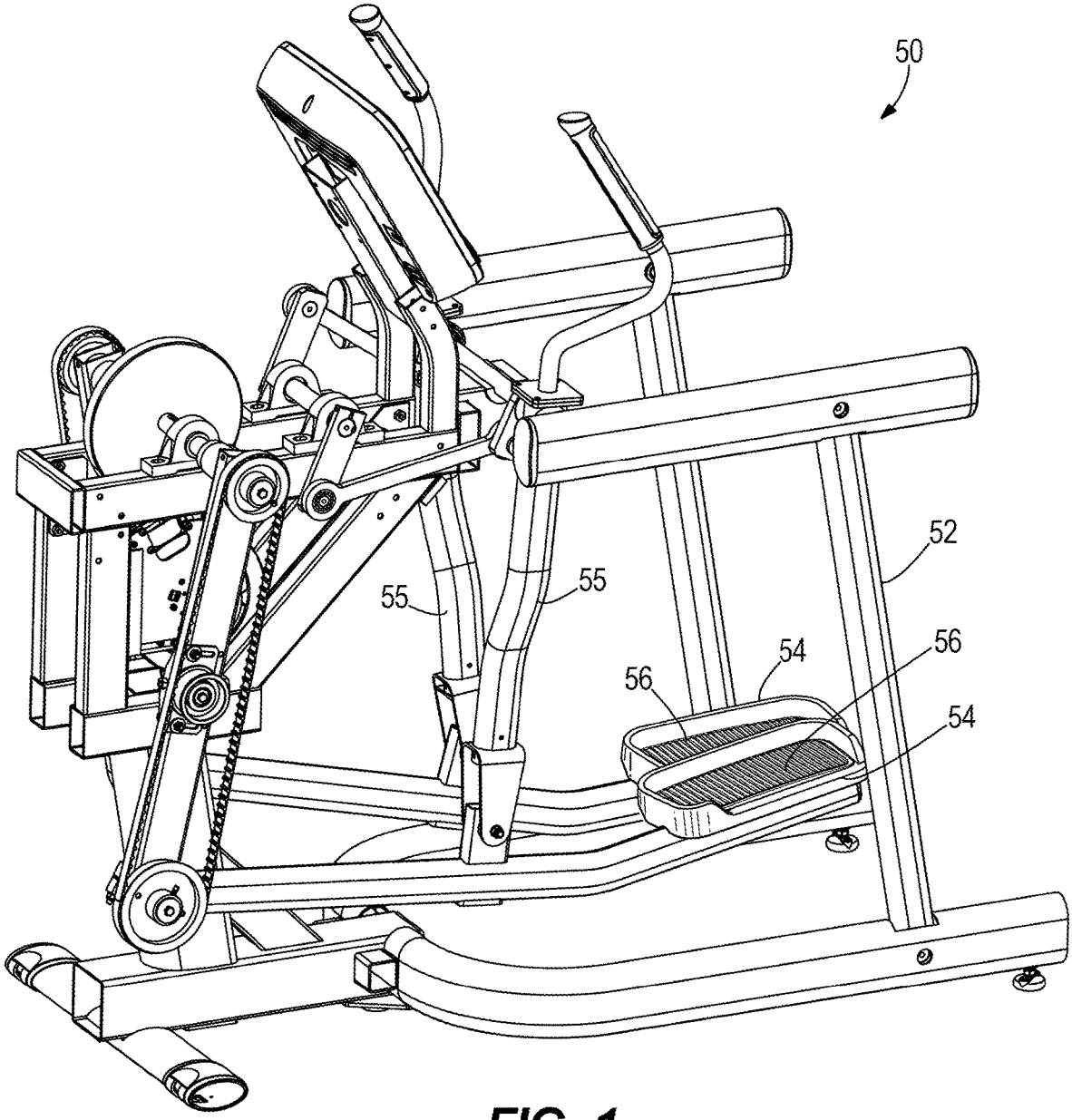
FIG. 1 is a perspective view of an exercise apparatus having pedals that are configured according to concepts of the present disclosure.

FIG. 1 depicts an exercise apparatus 50 having a frame 52 and pedals 54 that are supported with respect to the frame by pivot members 55. As described in the incorporated U.S. Pat. No. 9,283,425, the exercise apparatus 50, including frame 52, pedals 54, and pivot members 55, is configured to facilitate an elliptical striding exercise by a user. Although FIG. 1 depicts a particular embodiment of an exercise apparatus, the concepts of the present disclosure are fully applicable to other types of apparatuses for striding exercises, apart from what is shown, and apart from the disclosure of U.S. Pat. No. 9,283,425. Other examples of suitable apparatuses are provided in the patents that are listed herein above and incorporated herein by reference.

Conventional elliptical-motion-type exercise apparatuses, such as disclosed in the above-incorporated U.S. Patents, are designed to provide a stable pedal surface that travels through a specified motion path (e.g., an elliptical or stepping motion path) while remaining neutral in angle throughout the motion—so as not to force an "unnatural" foot/ankle position but rather allow the foot freedom of motion to lift the heel when desired. Such conventional apparatuses can have a relatively large pedal surface that allows freedom of foot placement and stance. However once the user finds a comfortable foot position, they tend to keep their feet in contact with the pedals throughout the range of motion, with the only change in foot position manifesting as a heel lift toward the back of the motion (e.g. elliptical motion) and during the initial part of the return phase.

Through research and experimentation, the present inventors have determined that continuous contact of the ball of the foot with the pedal, in addition to toe extension every time the heel lifts, can lead to a condition called transient paresthesia (numb foot) as the tissues move/swell and impinge on the nerves. The condition is not harmful and can be reversed by relieving pressure on the affected area (for instance, by shifting the center of force toward the heel rather than the ball of the foot). Realizing that this is a persistent complaint on weight-bearing products with pedals, the present inventors have endeavored to provide a means for alleviating the occurrence of numb foot.

Figure 2:
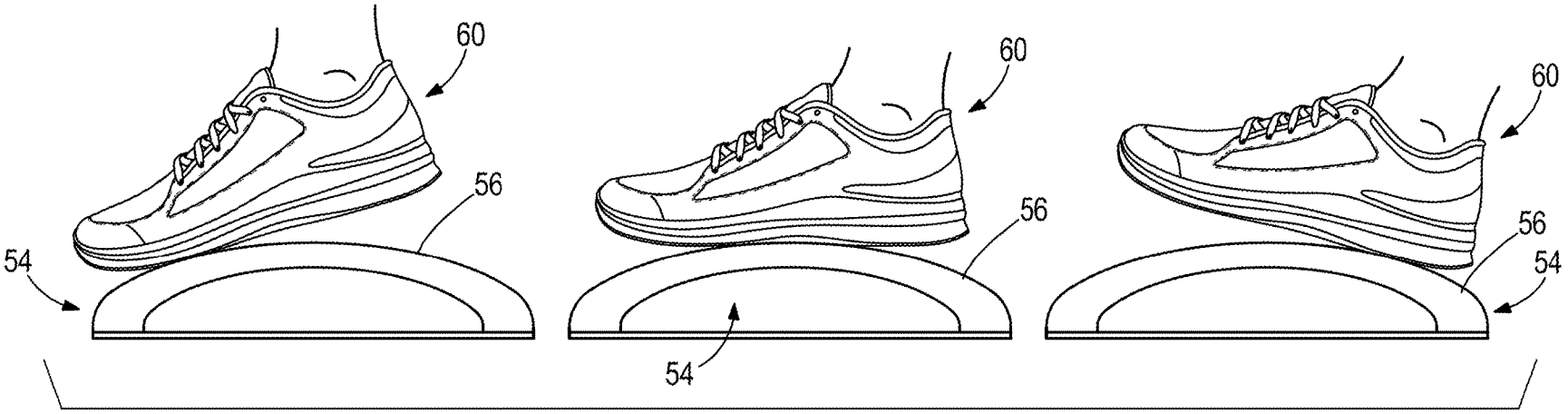
FIGS. 2-3 are schematic views of a user's foot engaged with a tread member configured according to the present disclosure.
Figure 3:
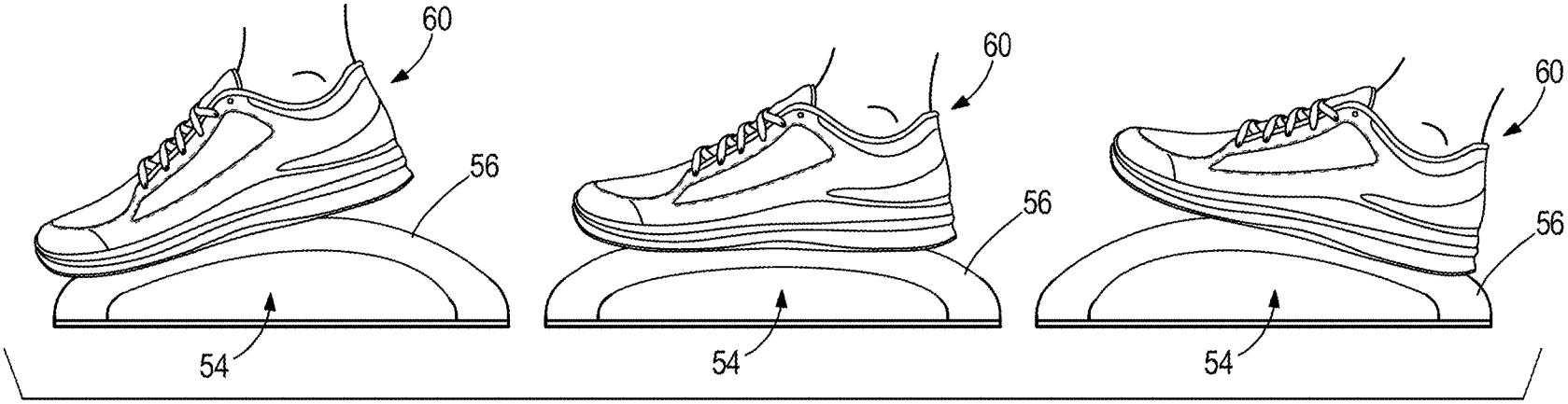

According to the present disclosure, the present inventors have determined that it can be beneficial to provide a pedal surface that is contoured (i.e. not planar) so that the foot achieves more of a rolling contact rather than a static contact. During testing, the present inventors found that contouring the pedal surface (see FIGS. 2-3) surprisingly resulted in a slight delay in the onset of numb foot for some users, and most users reported that the contoured surface felt comfortable throughout the range of motion. A secondary benefit of this concept is to allow the foot angle to vary slightly throughout the range of motion, since gait variation from person-to-person makes it impossible to capture the preferred pedal angle for all users. This effect can be considered similar to designing a mechanically articulating pedal to follow individual foot angles.

The present disclosure thus provides various example pedals 54 having a novel tread member 56 that is specially contoured to support the bottom of a user's foot 60 (see FIGS. 2 and 3) in a manner that advantageously encourages movement of user's foot 60 relative to the tread member 56 during the striding exercise. The movement can for example include a rolling motion between the bottom of the user's foot 60 and the tread member 56. This will cause a resulting change in angle between the user's foot 60 and a base of the pedal 54 and provide the advantages mentioned herein above.

Figure 4:
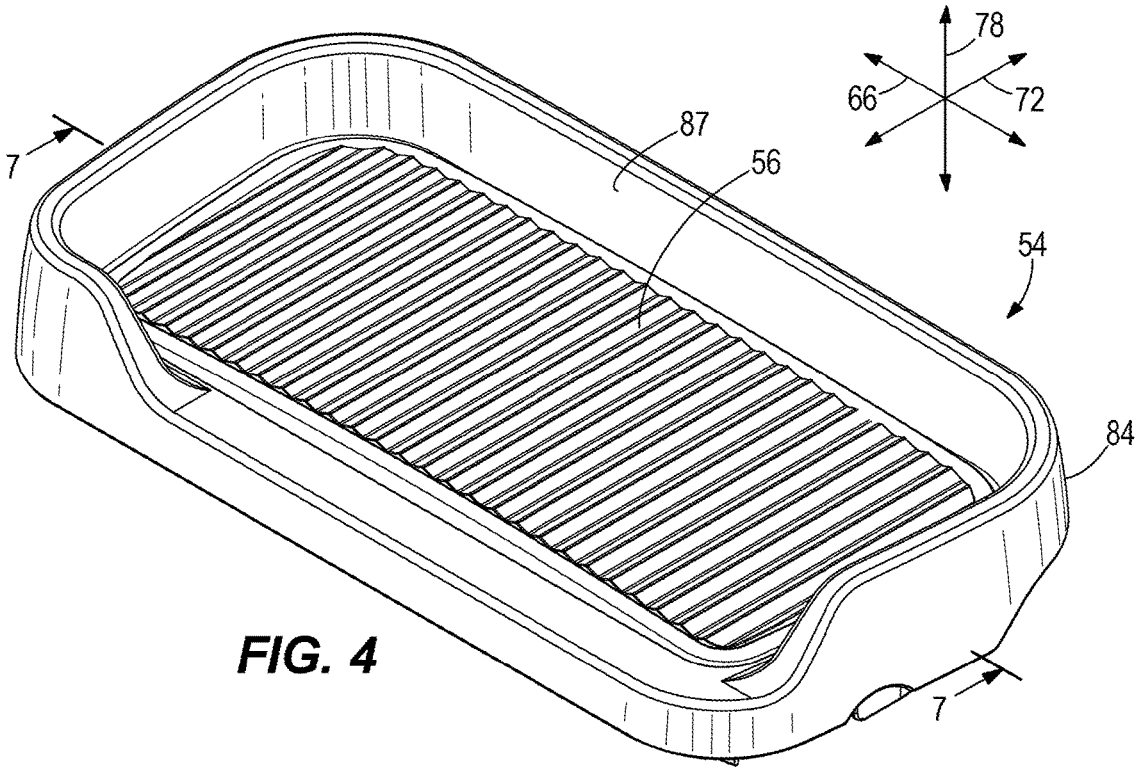
FIG. 4 is a perspective view of a first example of a pedal according to the present disclosure.
Figure 5:
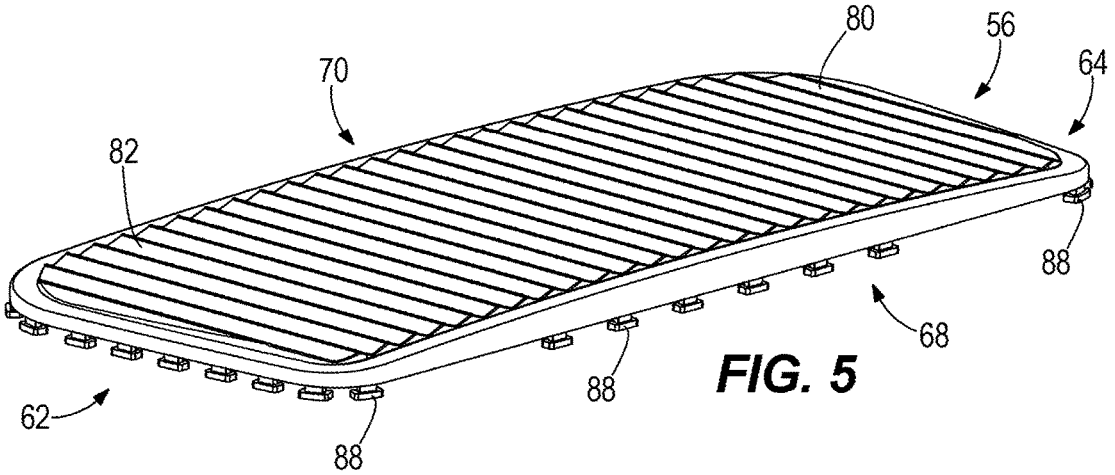
FIG. 5 is a perspective view of the tread member of the first example pedal.
Figure 6:
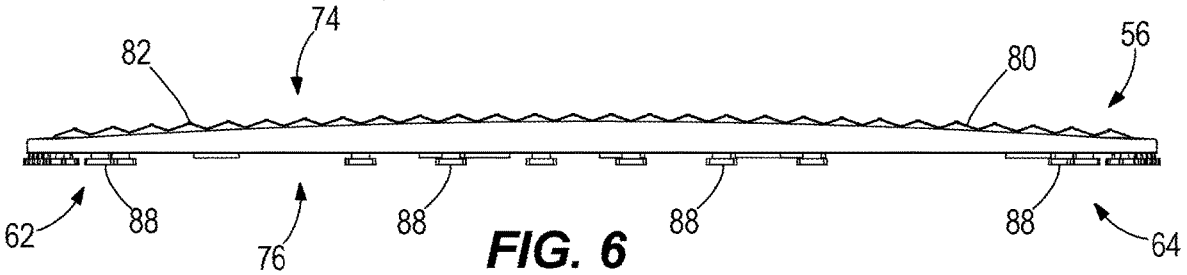
FIG. 6 is a side view of the tread member shown in FIG. 5.
Figure 7:
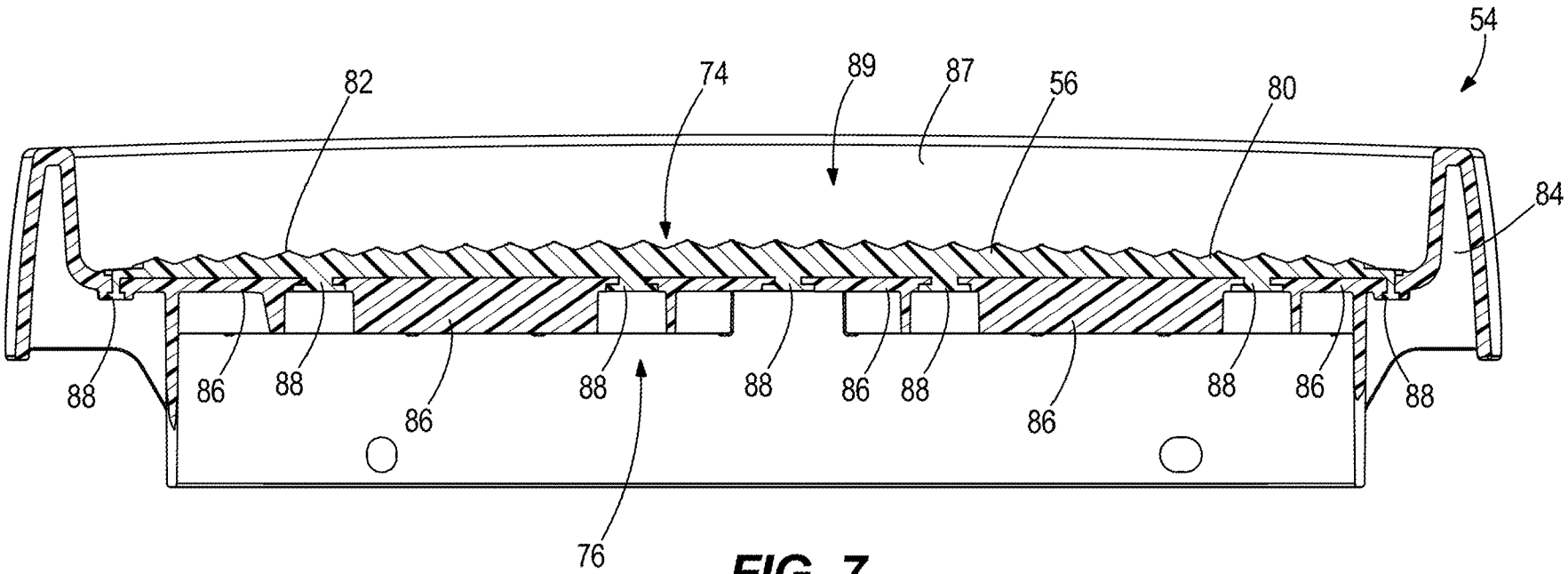
FIG. 7 is a view of section 7-7, taken in FIG. 4.

A first example of a pedal 54 according to the present disclosure is shown in FIGS. 4-7. The pedal 54 has a tread member 56 that extends longitudinally from front 62 to back 64 along a longitudinal axis 66, laterally from left side 68 to right side 70 along a lateral axis 72 that is perpendicular to the longitudinal axis 66, and vertically from bottom 74 to top 76 along a vertical axis 78 that is perpendicular to the longitudinal axis 66 and perpendicular to the lateral axis 72. The tread member 56 can, for example, be made of rubber or plastic. The tread member 56 has a specially contoured upper tread surface 80. As shown in FIG. 6, the contoured upper tread surface 80 is convex with respect to a plane extending through the longitudinal axis 66 and lateral axis 72 the longitudinal axis 66. The contoured upper tread surface 80 is symmetric along its length and has a constant radius of curvature with respect to the longitudinal axis 66. However in alternate examples, as will be further described herein below, the contoured upper tread surface 80 can be asymmetric along its length and/or have a non-constant radius of curvature with respect to the longitudinal axis 66. In this example, the tread member 56 has a uniform stiffness along the contoured upper tread surface 80, such that the tread member 56 provides a uniform resiliency to pressure from the bottom of the user's foot 60 as the user's foot 60 moves during the striding exercise. However in alternate examples, as will be further described herein below, the tread member 56 can have a non-uniform stiffness along the contoured upper tread surface 80, such that the tread member provides a non-uniform resiliency to pressure from the bottom of the user's foot 60 as the user's foot moves during the striding exercise. When viewed from above, the tread member 56 has a generally rectangular shape, however this is not limiting and the tread member 56 can have a different shape.

A plurality of protrusions 82 is formed on the tread member 56, particularly on the top of the contoured upper tread surface 80. The protrusions 82 are configured to provide tread (grip/traction) for the bottom of the user's foot 60 so that the user's foot 60 does not slip from the contoured upper tread surface 80. The configuration (e.g. size, shape, location) of the protrusions 82 can vary from what is shown. In the illustrated example, each protrusion 82 laterally extends across the contoured upper tread surface 80, from the left side 68 to the right side 70.

The pedal 54 has a base housing 84 that provides the above-mentioned base of the pedal 54. In this example, the tread member 56 is formed as a removable and replaceable insert that is supported on the base housing 84 by a series of stands 86. The tread member 56 has a plurality of locking tabs 88 that extend downwardly from the tread member 56 and mate with the series of stands 86 and the sidewalls 87 of the base housing 84, such that the tread member 56 can be manually removed for repair and/or replacement. In other examples the tread member 56 can be fixed to the base housing 84 or formed as one piece with the base housing 84. The sidewalls 87 of the base housing 84 extend upwardly from the base housing 84 and collectively define an interior 89 in which the tread members 56 is disposed.

FIGS. 8-40 depict additional examples of the pedal 54 having a tread member 56 according to the concepts of the present disclosure. The reference numbers from FIGS. 4-6 are shown in FIGS. 8-40 for the same or similar features.

Figure 8:
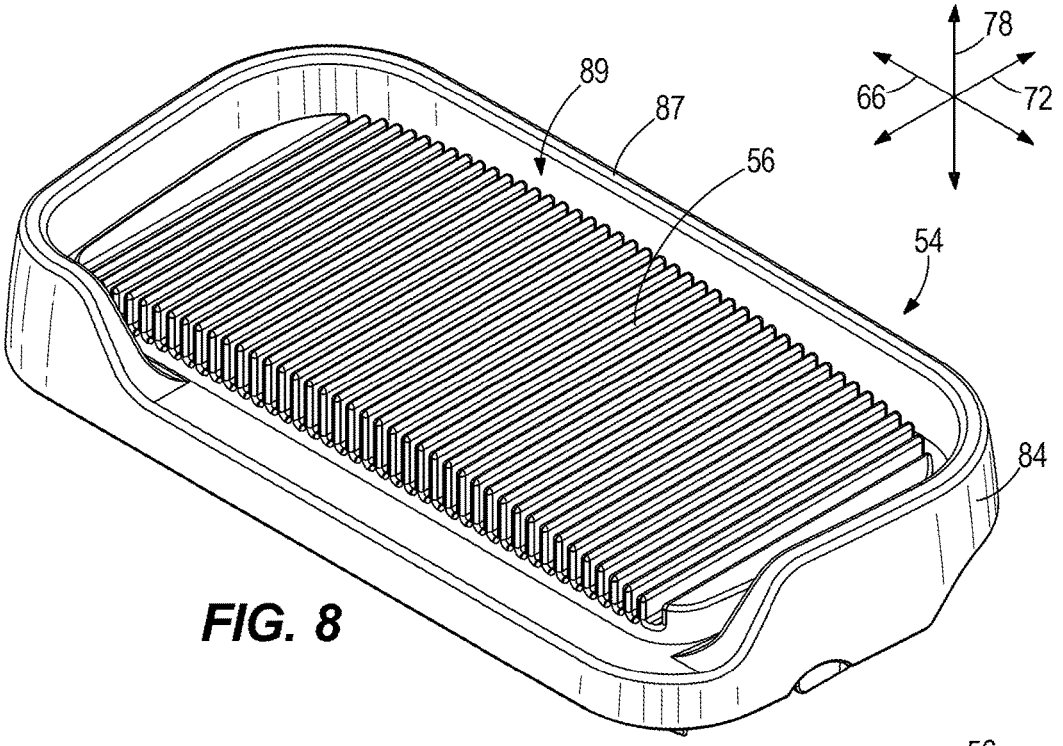
FIG. 8 is a perspective view of a second example of a pedal according to the present disclosure.
Figure 9:
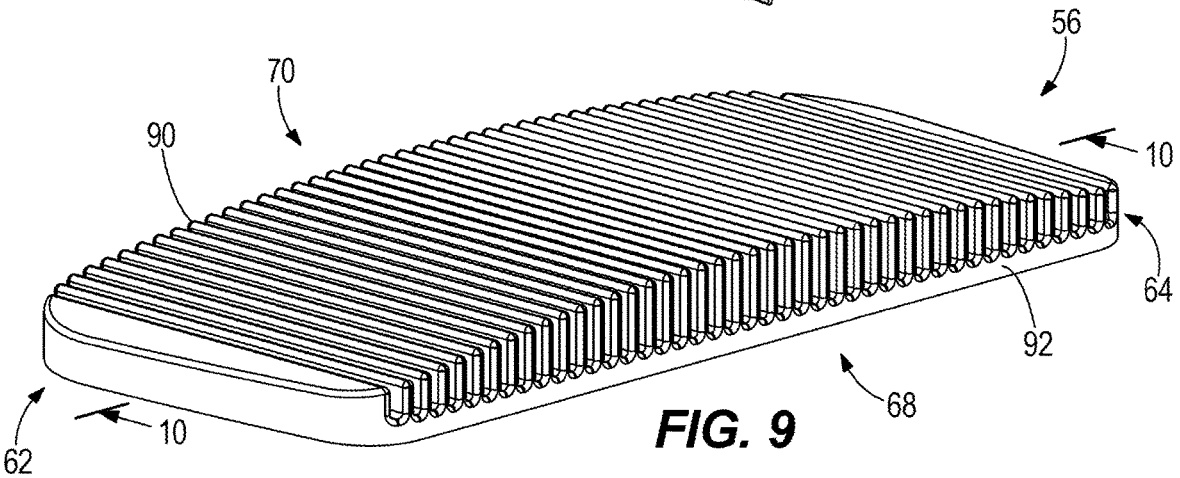
FIG. 9 is a perspective view of the tread member of the second example pedal.
Figure 10:
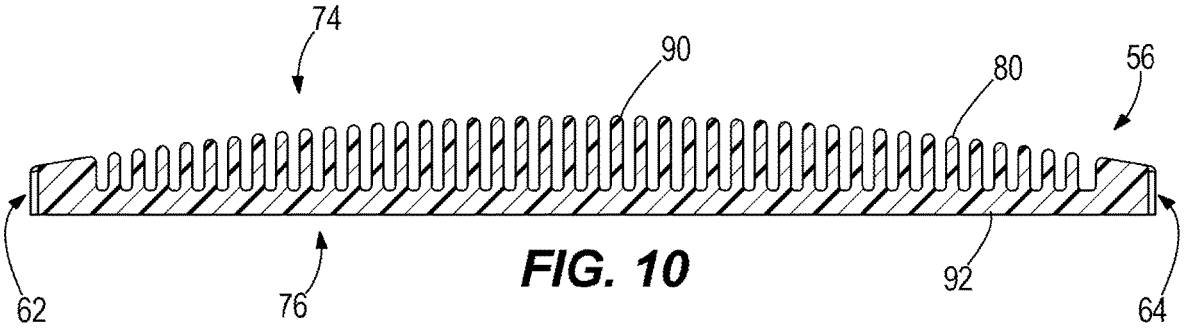
FIG. 10 is a view of section 10-10, taken in FIG. 9.

FIGS. 8-10 depict a second example wherein the contoured upper tread surface 80 is formed by a plurality of ribs 90 that are adjacent to each other and elongated with respect to the vertical axis 78. The ribs 90 have differing length in which the shortest ribs are located on the front 62 and back 64 and the longest ribs 90 are located mid-way between the front 62 and back 64. Thus, together the ribs 90 define the above-described convex shape. In this example, the convex shape is symmetric and follows a constant radius of curvature with respect to the longitudinal axis 66. However in other examples, the convex shape can be asymmetric and/or follow a non-constant radius of curvature with respect to the longitudinal axis 66. Each of the ribs 90 extends vertically from a common base member 92 that is planar and extends in a plane with respect to the longitudinal axis 66 and lateral axis 72, see FIG. 10. The ribs 90 together provide a uniform stiffness along the contoured upper tread surface 80 such that the tread member 56 provides the above noted uniform resiliency to pressure from the bottom of the user's foot 60 as the user's foot 60 moves during the striding exercise. In other examples, the ribs 90 can have varying stiffness amongst each other such that the tread member 56 provides a non-uniform resiliency to pressure from the bottom of the user's foot 60 as the user's foot 60 moves during the striding exercise. In other examples, the ribs 90 can have the same length and the common base member 92 can be convex or concave to thereby form the contoured upper tread surface 80.

Figure 11:
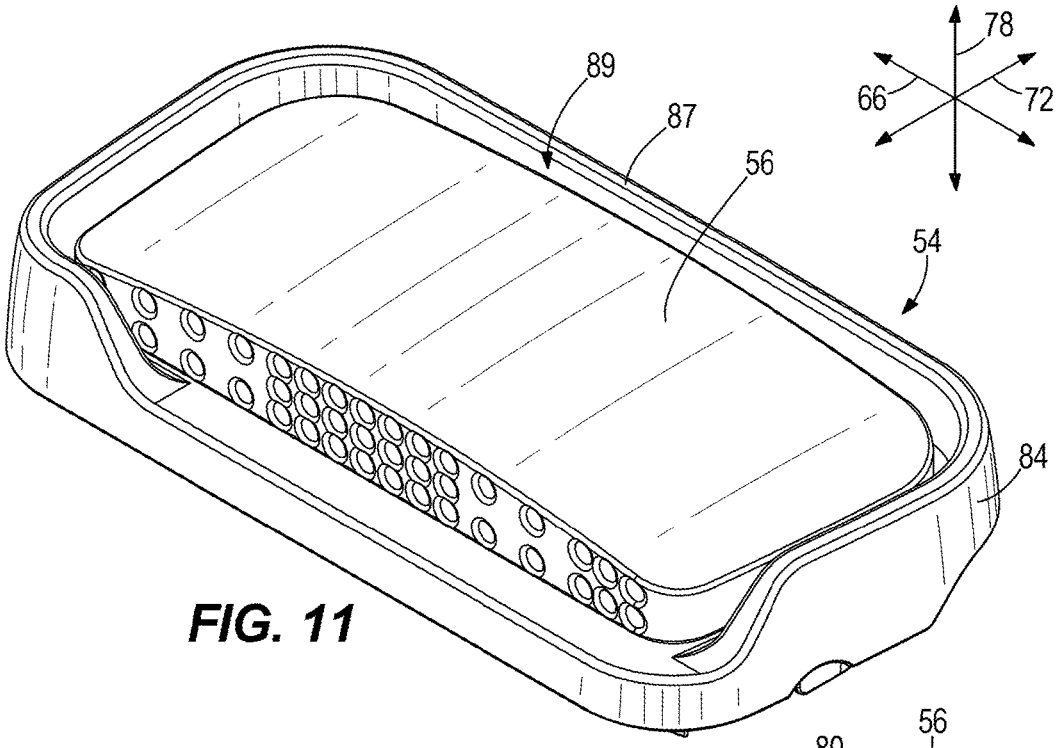
FIG. 11 is a perspective view of a third example of a pedal according to the present disclosure.
Figure 12:
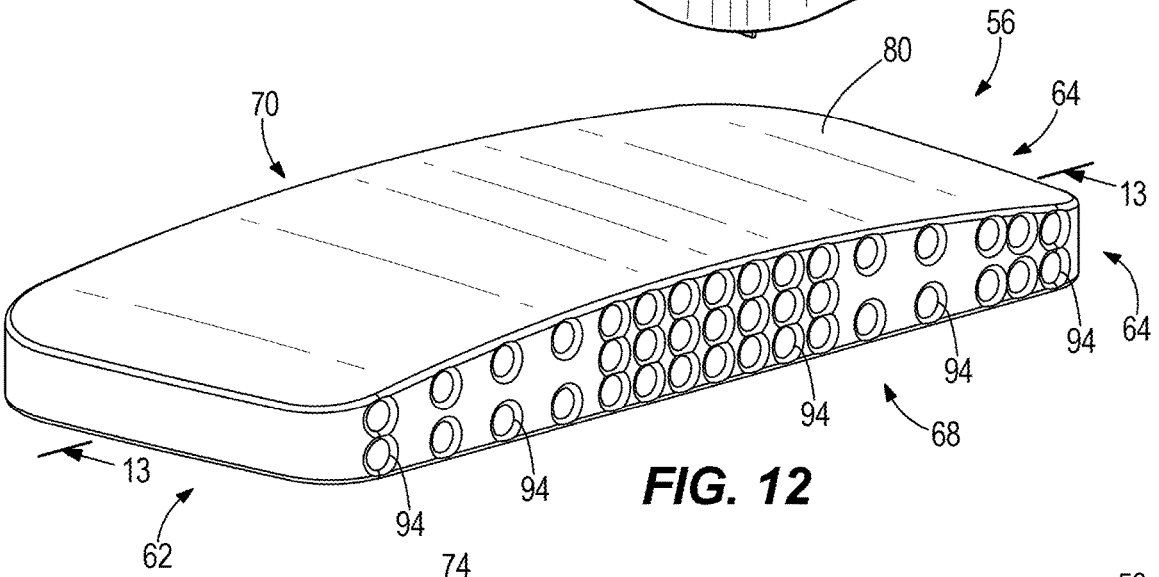
FIG. 12 is a perspective view of the tread member of the third example pedal.
Figure 13:
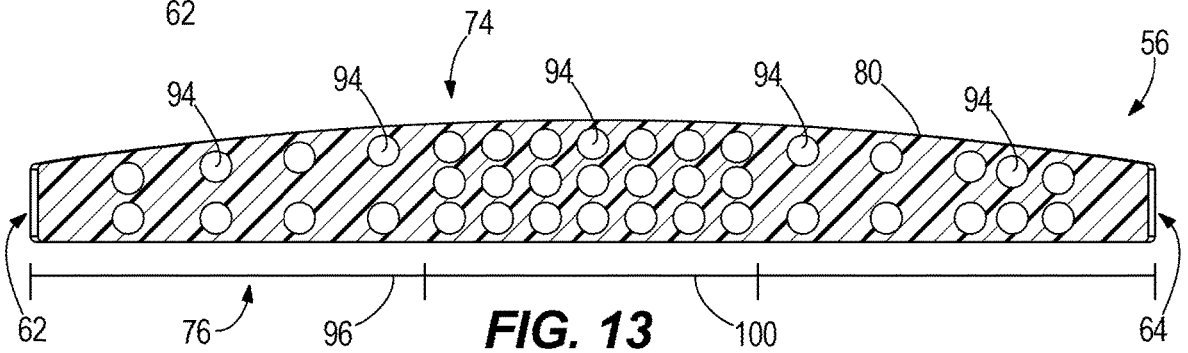
FIG. 13 is a view of section 13-13, taken in FIG. 12.

FIGS. 11-13 depict a third example wherein the tread member 56 provides a varying stiffness along the contoured upper tread surface 80 such that the tread member 56 (which, for example, can be made of rubber) provides a non-uniform resiliency to pressure from the bottom of the user's foot 60. The non-uniform resiliency can advantageously facilitate increased contact area between the bottom of the user's foot 60 and the tread member 56. It can also allow for the above-noted change in angle between the user's foot 60 and base (e.g. base housing 84) of the pedal 54. In this example, the tread member 56 has a plurality of cross-bores 94 that laterally extend through the tread member 56. As shown in the drawings, the number and spacing of the cross-bores 94 varies along the length of the tread member 56 with respect to the longitudinal axis 66. The configuration (size, spacing, shape) of the cross-bores 94 affects the resiliency of the tread member 56 with respect to the pressure from the bottom of the user's foot 60 at a location that is directly vertically above the respective cross-bores 94. The designer, by varying the configuration of the cross-bores 94 along the longitudinal axis 66, can control or tailor the resiliency of the tread member 56 along the contoured upper tread surface 80. The height of the tread member 56 with respect to the vertical axis 78 (i.e. the thickness of the resilient material along the vertical axis 78) also affects the resiliency of the tread member 56 along the longitudinal axis 66. For example, referring to FIG. 13, it can be stated that the tread member 56 has a longitudinally forward section 96 having a first stiffness that provides a first resiliency with respect to the pressure from the bottom of the user's foot 60, a longitudinally rearward section 98 having a second stiffness that provides a second resiliency with respect to the pressure from the bottom of the user's foot 60, and a middle section 100 located between the longitudinally forward section 96 and longitudinally rearward section 98. The middle section 100 has a third stiffness that provides a third resiliency with respect to the pressure from the bottom of the user's foot 60. In the illustrated example, the third resiliency along the middle section 100 is designed to be less than the first and second resiliencies along the longitudinally forward and rearward sections 96, 98 because there are an increased number of cross-bores 94 that are located closer together in formation. Because the configuration of cross-bores 94 and the height of the tread member 56 is the same along the longitudinally forward and rearward sections 96, 98, the first and second resiliencies are the same or approximately the same.

Figure 14:
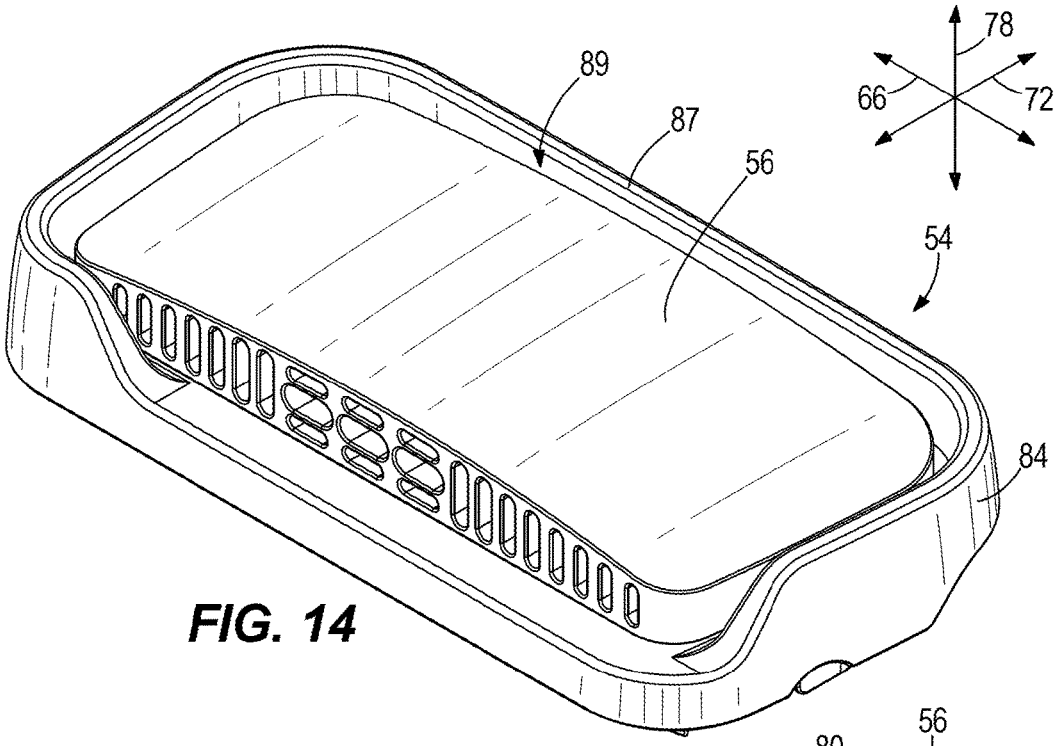
FIG. 14 is a perspective view of a fourth example of a pedal according to the present disclosure.
Figure 15:
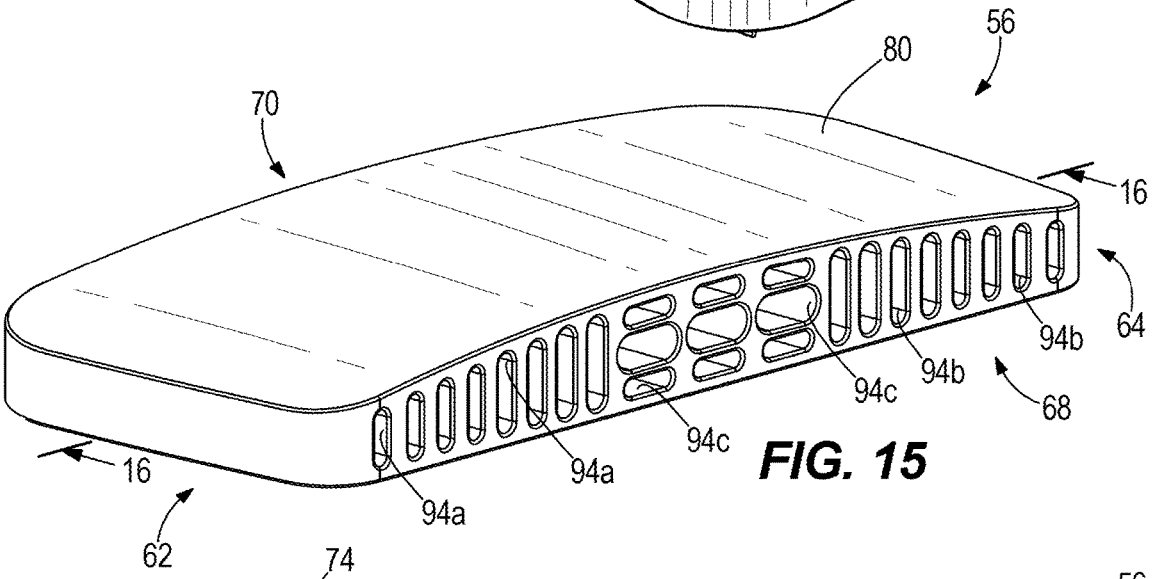
FIG. 15 is a perspective view of the tread member of the fourth example pedal.
Figure 16:
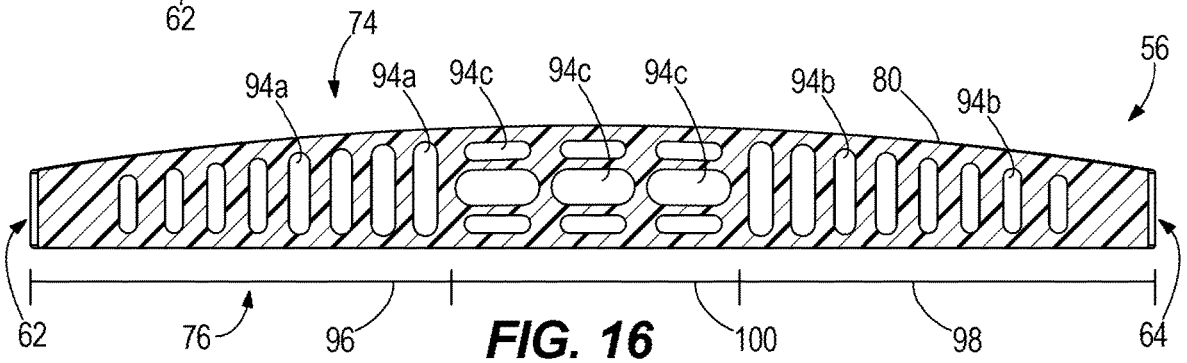
FIG. 16 is a view of section 16-16, taken in FIG. 15.

FIGS. 14-16 depict a fourth example having a first set of cross-bores 94*a* located in the longitudinally forward section 96, a second set of cross-bores 94*b* located in the longitudinally rearward section 98, and a third set of cross-bores 94*c* located in the middle section 100. The third set of cross-bores 94*c* has a different size and shape compared to the first and second sets of cross-bores 94*a*, 94*b*. In this example, the third set of cross-bores is elongated with respect to the longitudinal axis 66, whereas the first and second sets of cross-bores 94*a*, 94*b* are elongated with respect to the vertical axis 78. The first and second sets of cross-bores 94*a*, 94*b* increase in height along with the height of the tread member 56 (i.e. follow the convex shape of the tread member 56). The third set of cross bores 94*c* includes relatively larger cross-bores 94*c* vertically between relatively smaller cross-bores 94*c*. As with the example shown in FIGS. 11-13, the longitudinally forward and rearward sections 96, 98 have resiliencies that are the same or approximately the same. The middle section 100 has a resiliency that is different than the longitudinally forward and rearward sections 96, 98.

Figure 17:
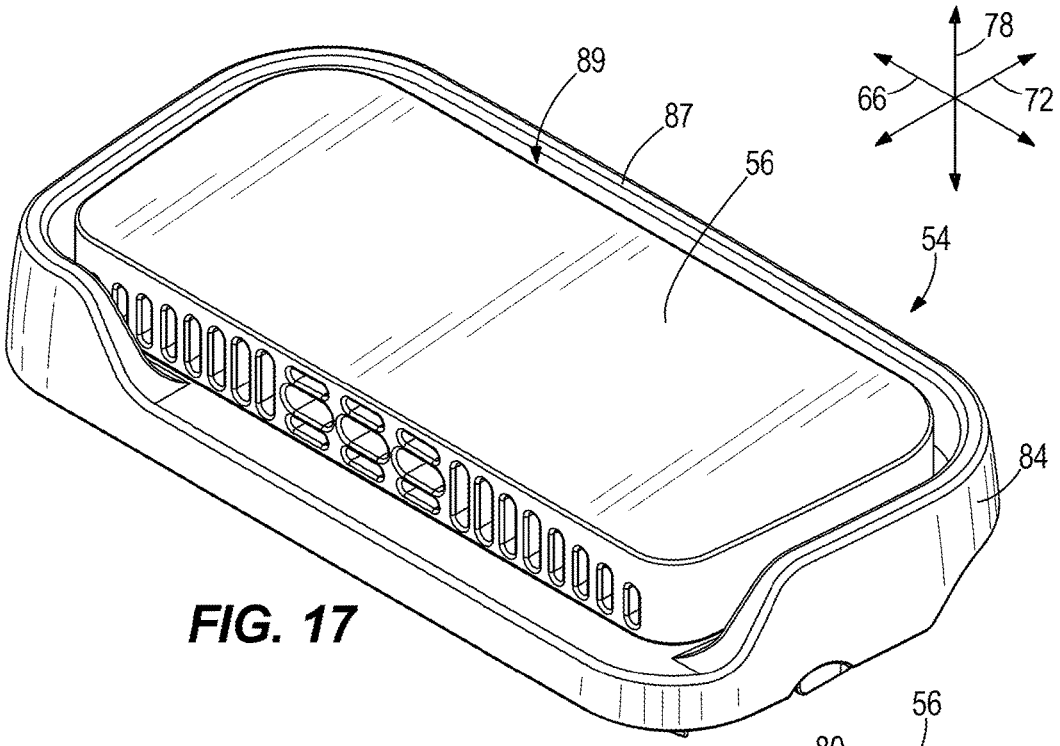
FIG. 17 is a perspective view of a fifth example of a pedal according to the present disclosure.
Figure 18:
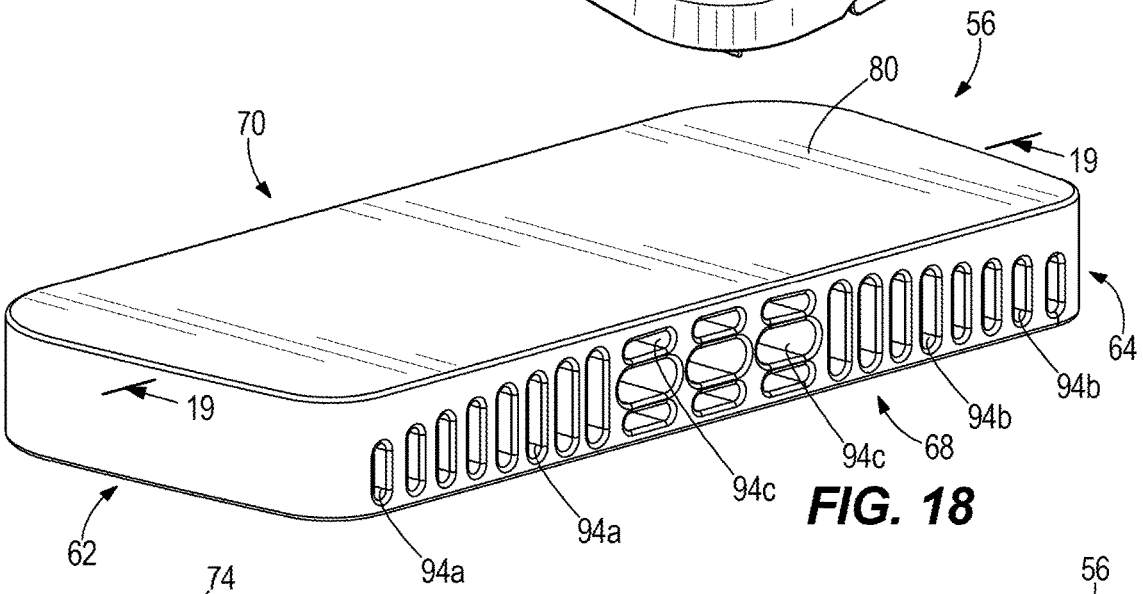
FIG. 18 is a perspective view of the tread member of the fifth example pedal.
Figure 19:
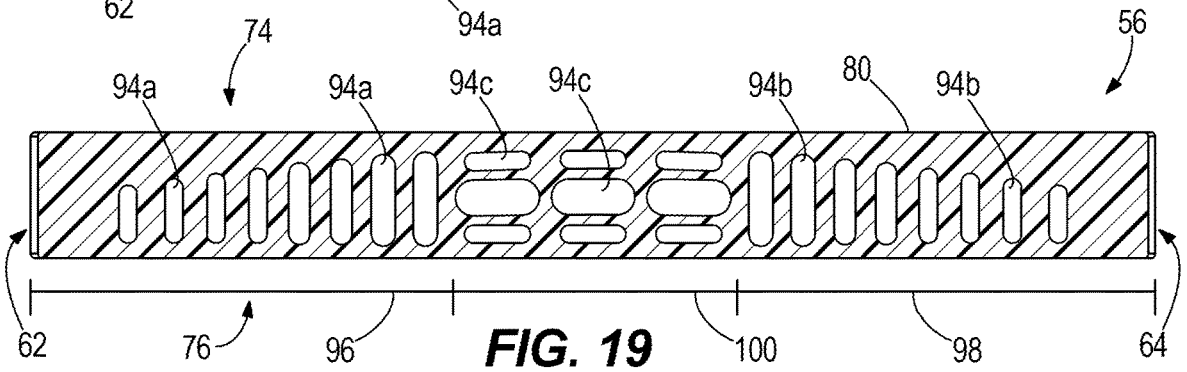
FIG. 19 is a view of section 19-19, taken in FIG. 18.

FIGS. 17-19 depict a fifth example, which is like what is shown in FIGS. 14-16, except that the tread member 56 has a planar upper tread surface 102 instead of the contoured upper tread surface 80 shown in FIGS. 14-16. The difference in resiliency between the longitudinally forward and rearward sections 96, 98 versus the middle section 100 encourages movement (e.g., change in angle) of the bottom of the user's foot 60 relative to the noted base of the pedal 54 during the striding exercise.

Figure 20:
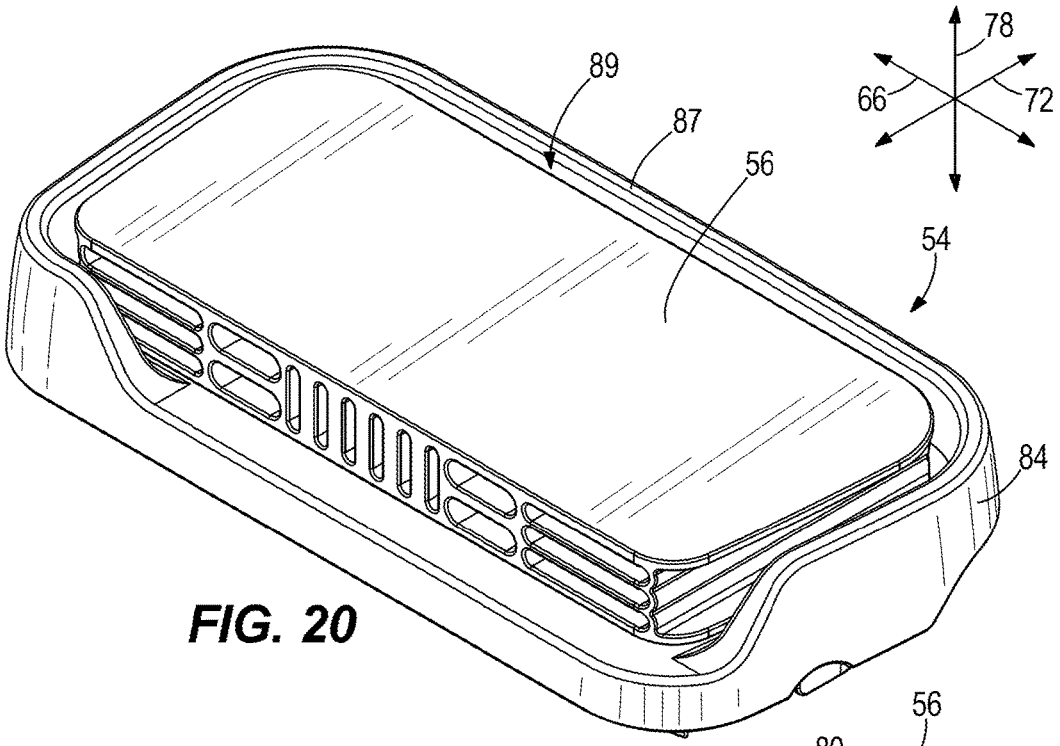
FIG. 20 is a perspective view of a sixth example of a pedal according to the present disclosure.
Figure 21:
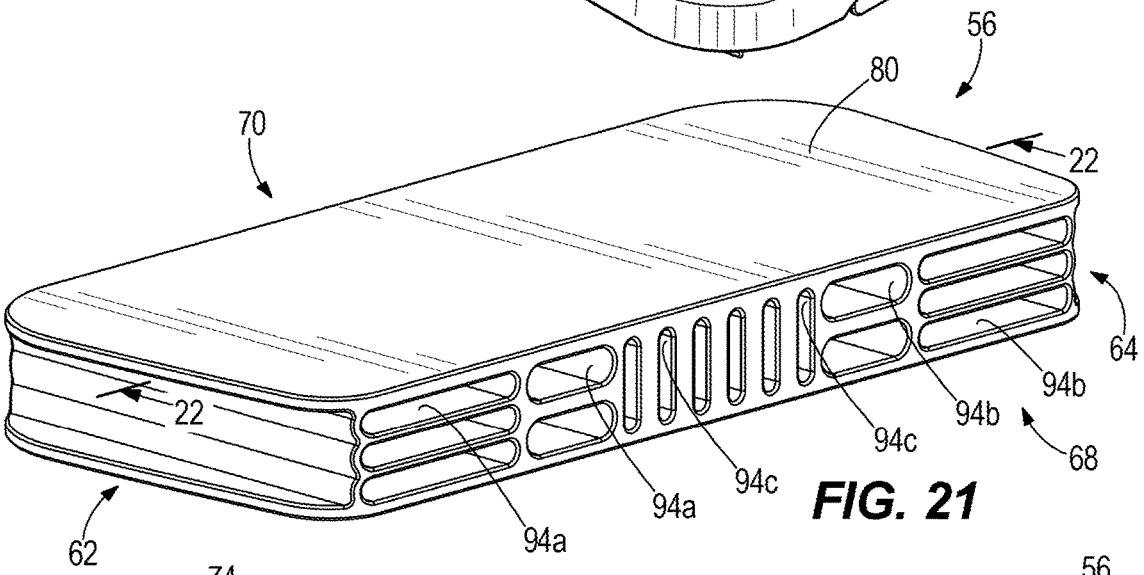
FIG. 21 is a perspective view of the tread member of the sixth example pedal.
Figure 22:
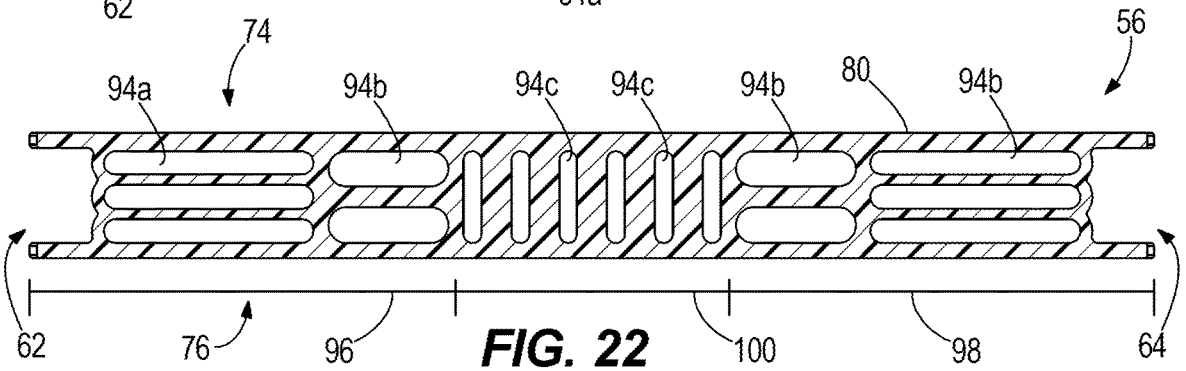
FIG. 22 is a view of section 22-22, taken in FIG. 21.

FIGS. 20-21 depict a sixth example that is similar to what is shown in FIGS. 17-19, except for having a different configuration of cross-bores 94. The first and second sets of cross-bores 94*a*, 94*b* are elongated with respect to the longitudinal axis 66 and the third set of cross-bores 94*c* are elongated with respect to the vertical axis 78. The first and second sets of cross-bores 94*a*, 94*b* each include differently sized cross-bores, including shorter, wider cross-bores compared to longer, skinnier cross-bores. The front 62 and back 64 have open channels 65.

Figure 23:
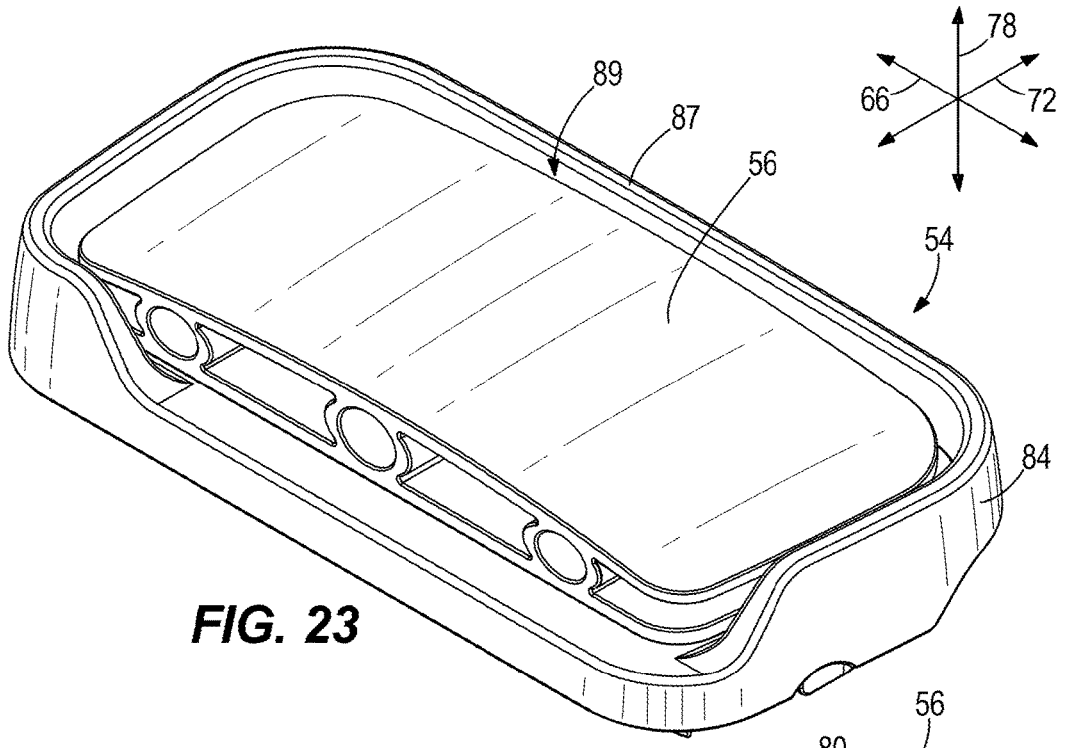
FIG. 23 is a perspective view of a seventh example of a pedal according to the present disclosure.
Figure 24:
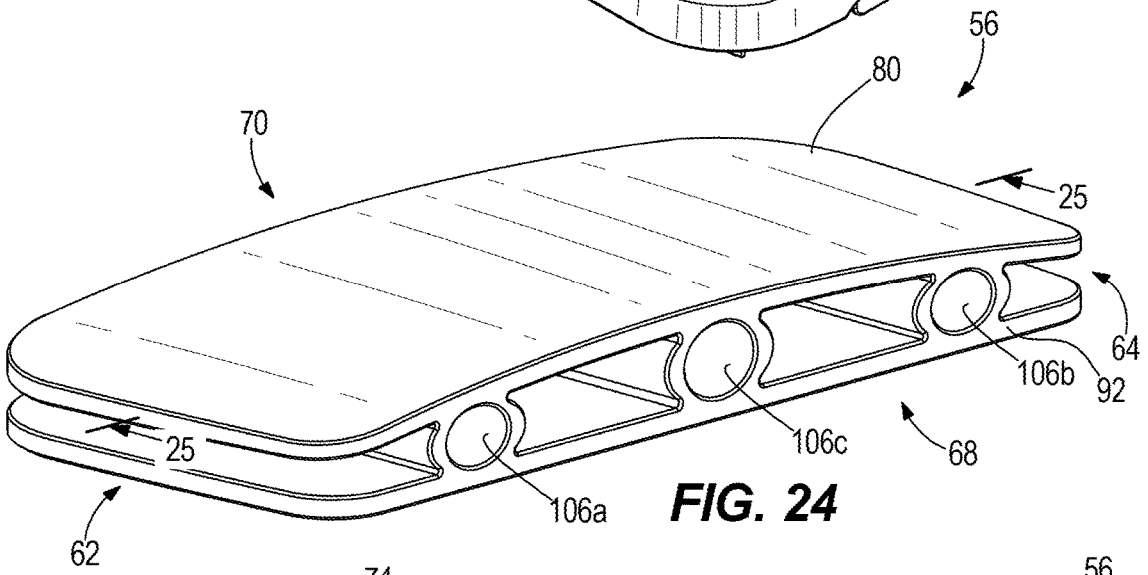
FIG. 24 is a perspective view of the tread member of the seventh example pedal.
Figure 25:
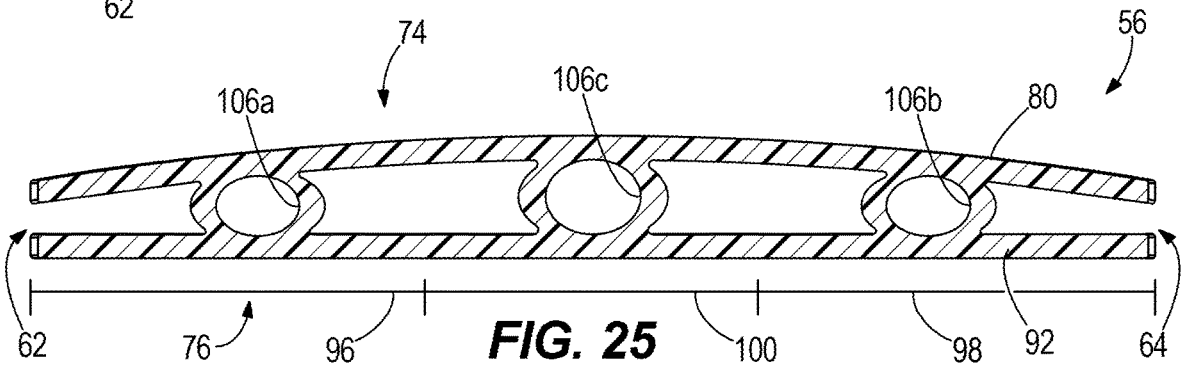
FIG. 25 is a view of section 25-25, taken in FIG. 24.

FIGS. 23-25 depict a seventh example wherein the tread member 56 has an upper tread member 104, a base member 92, and a plurality of laterally-extending suspension tubes 106 that supports the upper tread member 104 with respect to a lower tread member 108. The suspension tubes 106 include forward and rearward suspension tubes 106*a*, 106*b* and an intermediate suspension tube 106*c* located between the forward and rearward suspension tubes 106*a*, 106*b*. The intermediate suspension tube 106*c* is size larger than the forward and rearward suspension tubes 106*a*, 106*b* and thus provides a different resiliency to pressure from the bottom of the user's foot 60 compared to the forward and rearward suspension tubes 106*a*, 106*b*. The respective sizes of the suspension tubes 106 support the upper tread member 104 apart from the lower tread member 108 so that the contoured upper tread surface 80 has the above-described convex shape with respect to the longitudinal axis 66.

Figure 26:
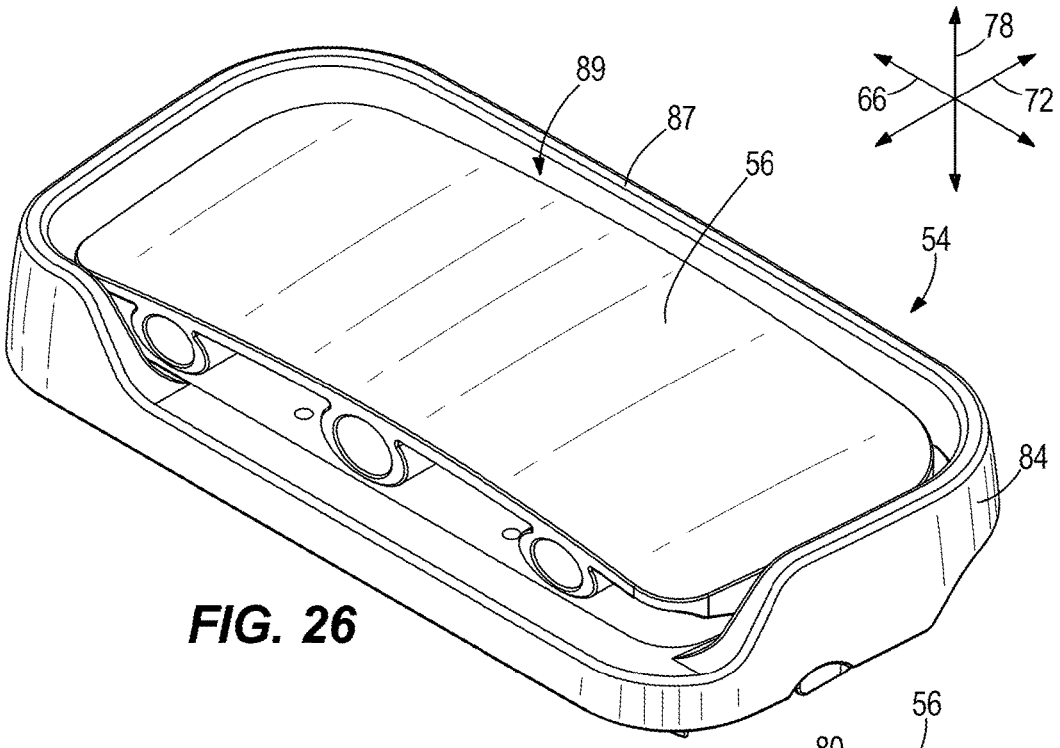
FIG. 26 is a perspective view of an eighth example of a pedal according to the present disclosure.
Figure 27:
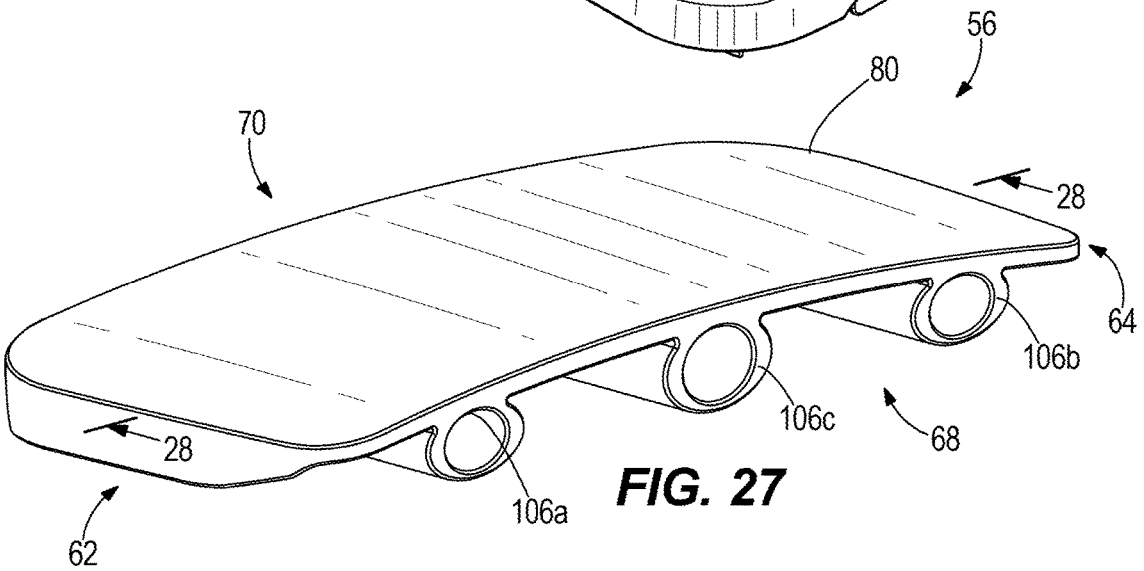
FIG. 27 is a perspective view of the tread member of the eighth example pedal.
Figure 28:
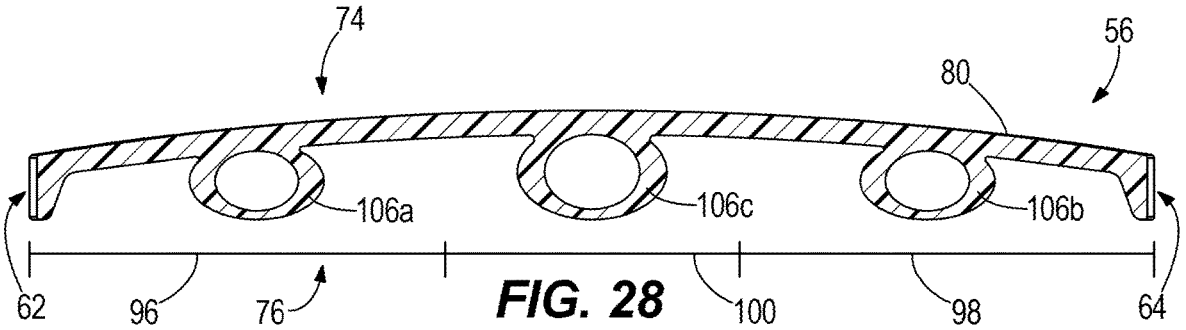
FIG. 28 is a view of section 28-28, taken in FIG. 27.

FIGS. 26-28 depict an eighth example that is just like the seventh example, except it omits the lower tread member 108. In this example, the suspension tubes 106 rest directly on the base housing 84 of the pedal 54. Outer flanges 113 project downwardly from the upper tread member 104 at the front and back 62, 64.

Figure 29:
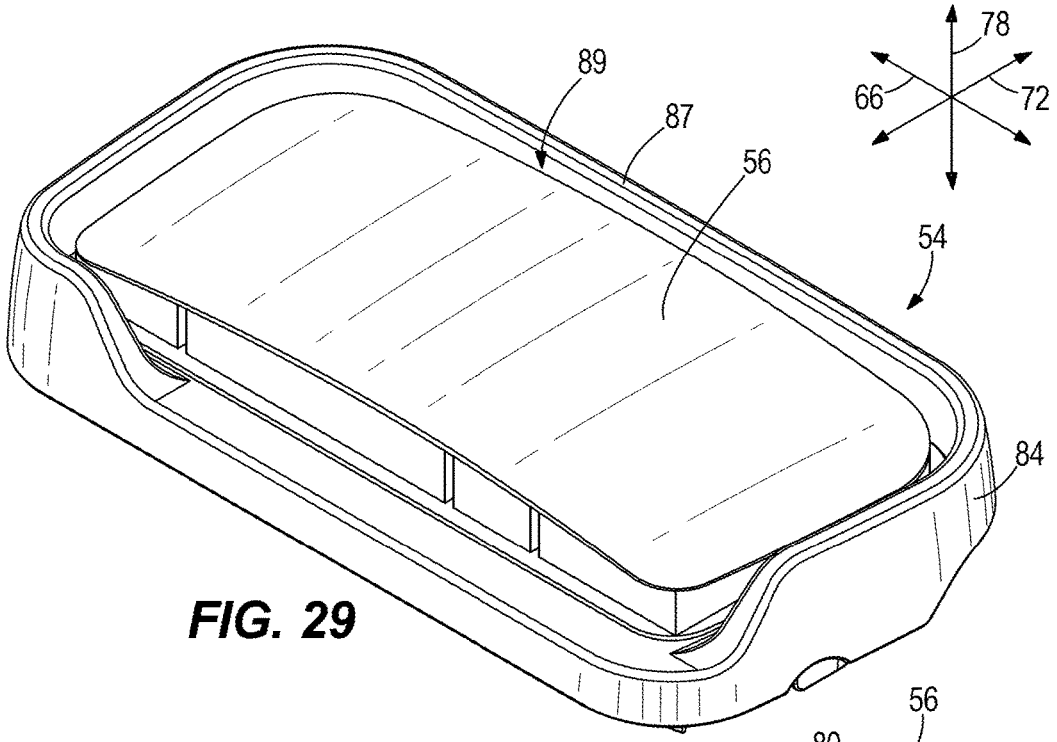
FIG. 29 is a perspective view of a ninth example of a pedal according to the present disclosure.
Figure 30:
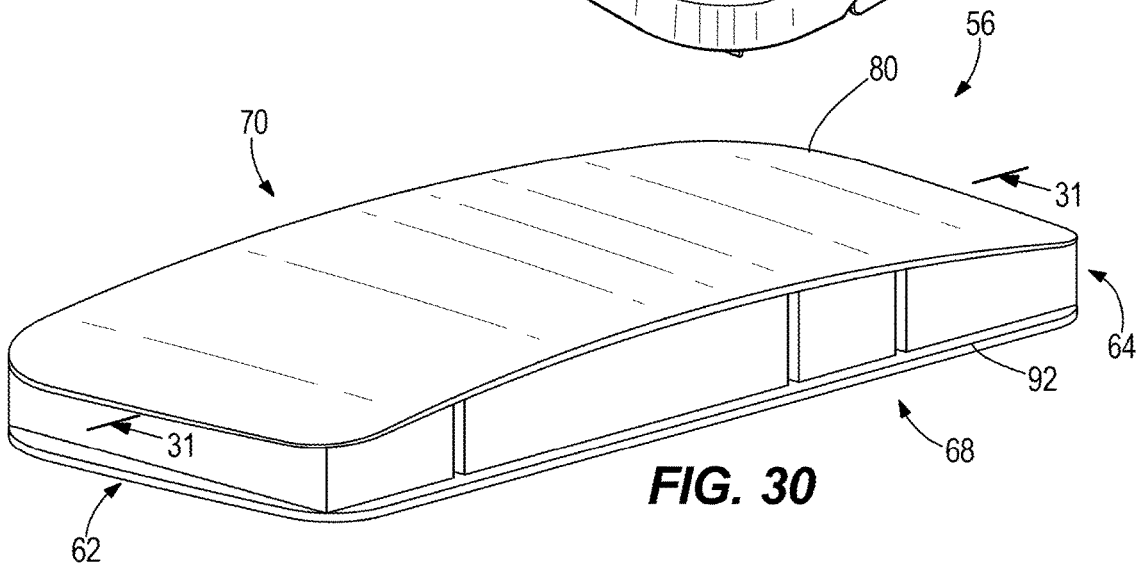
FIG. 30 is a perspective view of the tread member of the ninth example pedal.
Figure 31:
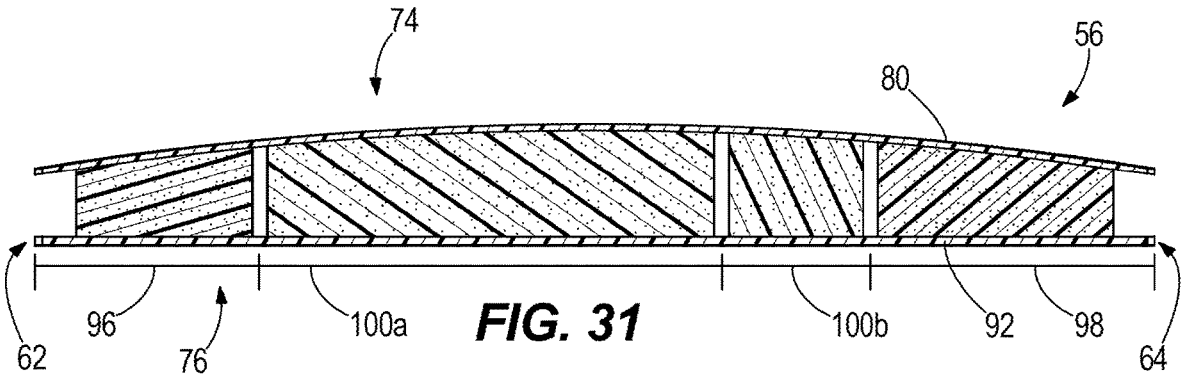
FIG. 31 is a view of section 31-31, taken in FIG. 30.

FIGS. 29-31 depict a ninth example, wherein the tread member 56 has a longitudinally forward section 96 that is formed from a first material (e.g., one type of rubber) providing a first resiliency, the longitudinally rearward section 98 formed from a second material (e.g., another type of rubber) providing the second resiliency, and the middle section 100 including two sub-sections 100*a*, 100*b*, each being formed from different materials (e.g., different types of rubber) having third and fourth resiliencies. The respective materials can be selected by the designer so that the resiliency changes along the tread member 56 with respect to the longitudinal axis 66.

Figure 32:
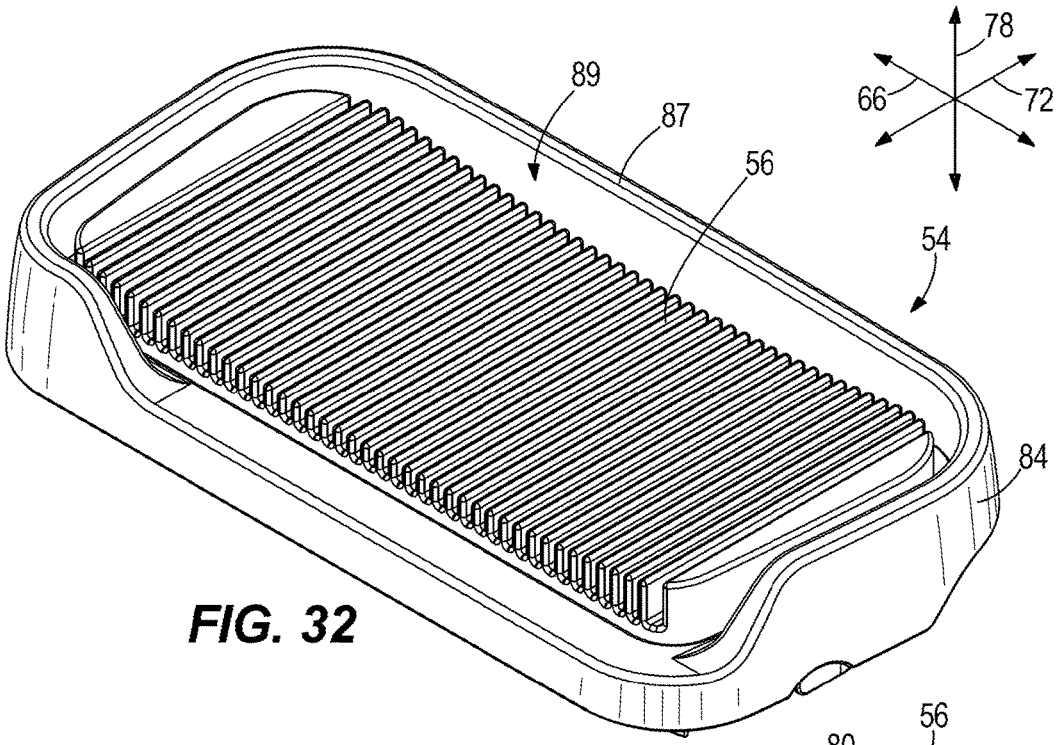
FIG. 32 is a perspective view of a tenth example of a pedal according to the present disclosure.
Figure 33:
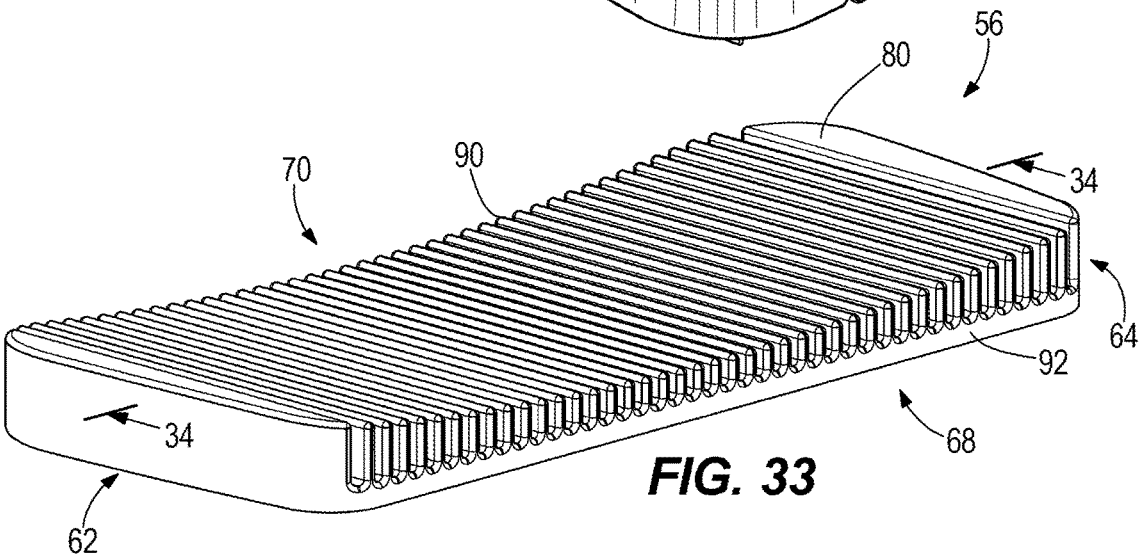
FIG. 33 is a perspective view of the tread member of the tenth example pedal.
Figure 34:
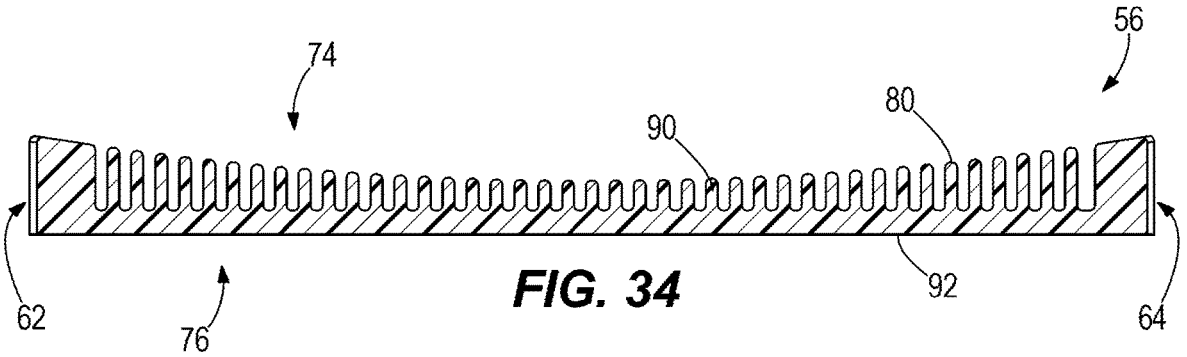
FIG. 34 is a view of section 34-34, taken in FIG. 33.

FIGS. 32-34 depict a tenth example, which is very similar to the example shown in FIGS. 8-10, except the ribs 90 together form a contoured upper tread surface 80 that is concave with respect to the longitudinal axis 66.

Figure 35:
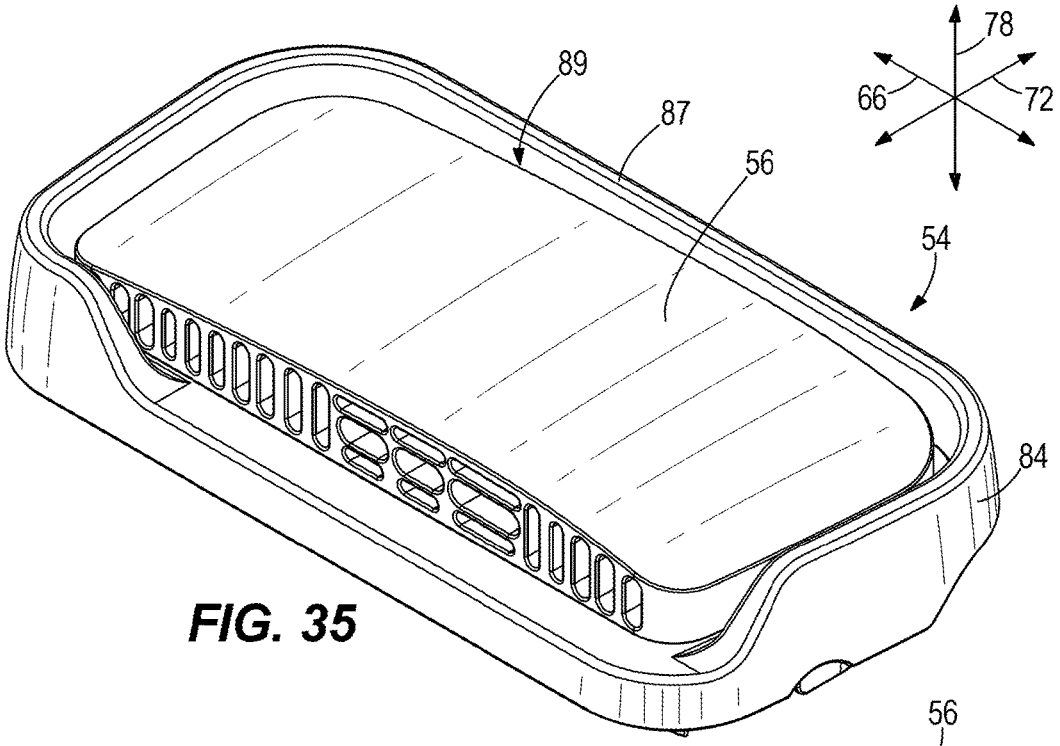
FIG. 35 is a perspective view of an eleventh example of a pedal according to the present disclosure.
Figure 36:
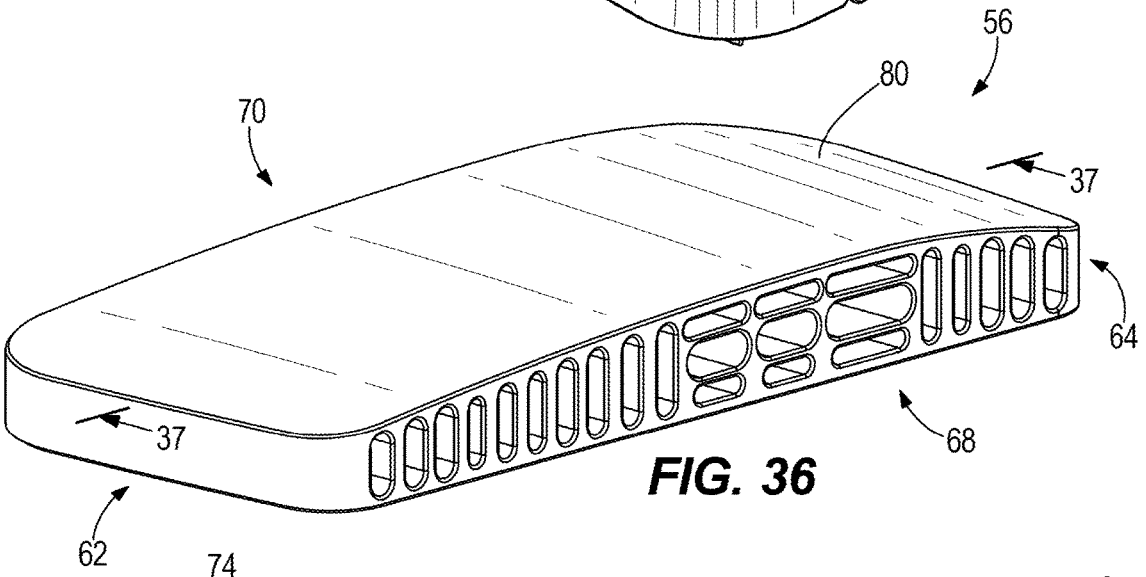
FIG. 36 is a perspective view of the tread member of the eleventh example pedal.
Figure 37:
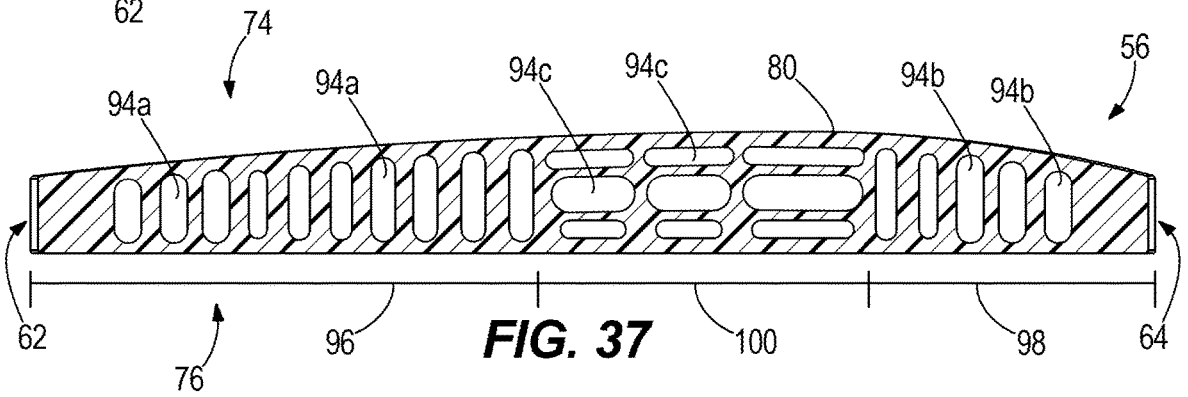
FIG. 37 is a view of section 37-37, taken in FIG. 36.

FIGS. 35-37 depict an eleventh example, that is very similar to the example shown in FIGS. 14-16, except the contoured upper tread surface 80 is asymmetric with respect to the longitudinal axis 66 and has a non-constant radius of curvature with respect to the longitudinal axis 66. Specifically the apex of the contoured upper tread surface 80 is located closer to the back 64 than the front 62. Some of the cross-bores 94*c* are more elongated than the remaining cross-bores 94*c*. Some of the cross-bores 94*a*, 94*b* have a differently sized cross-section than the remaining cross-bores 94*a*, 94*b*.

Figure 38:
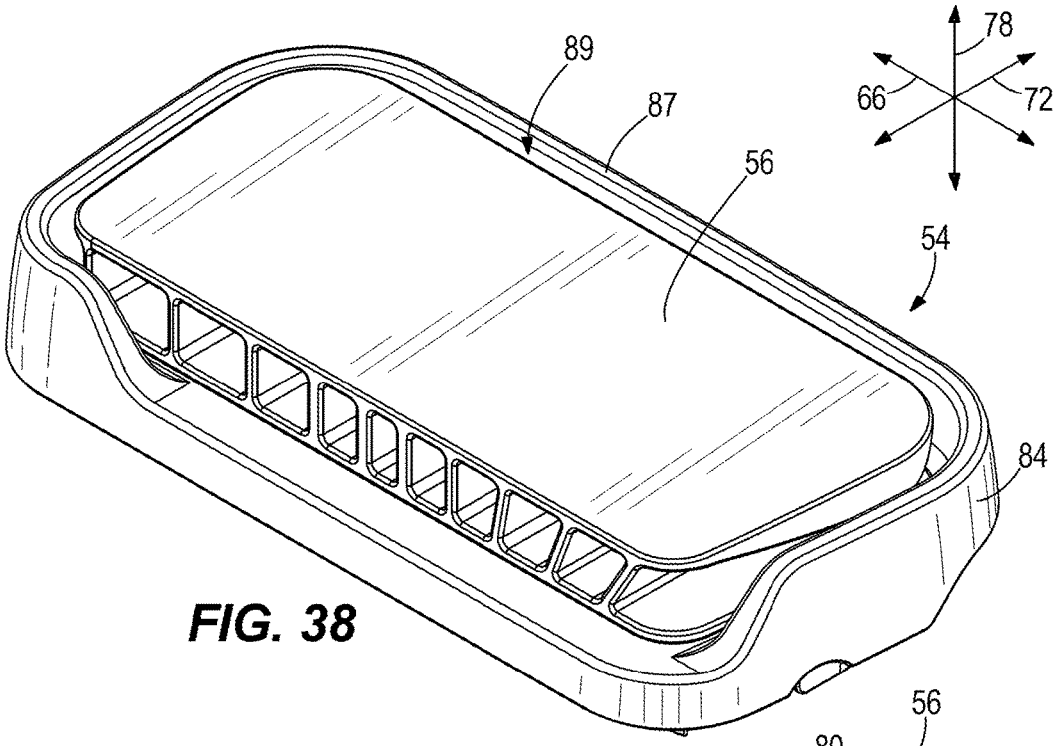
FIG. 38 is a perspective view of a twelfth example of a pedal according to the present disclosure.
Figure 39:
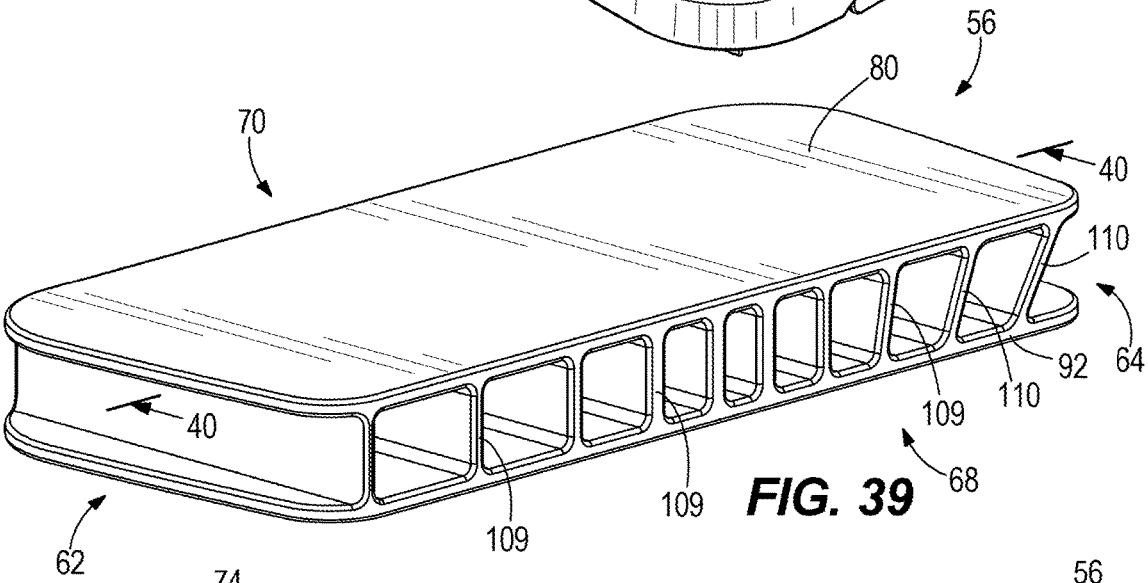
FIG. 39 is a perspective view of the tread member of the twelfth example pedal.
Figure 40:
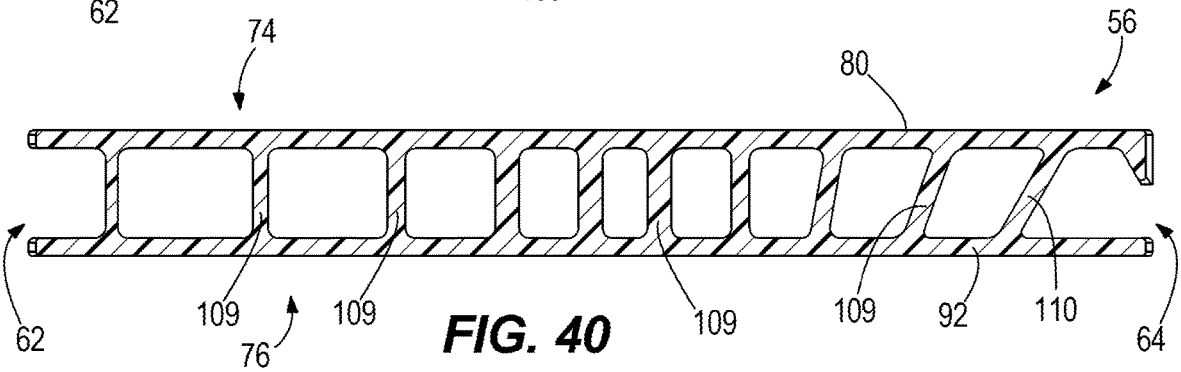
FIG. 40 is a view of section 40-40, taken in FIG. 39.

FIGS. 38-40 depict a twelfth example, wherein the upper tread member 104 and base 92 are both planar and extend parallel to each other and with respect to the longitudinal and lateral axes 66, 72. A plurality of vertical ribs 109 extend between the upper tread member and base 92 and define a plurality of cross-bores 94 there between. A plurality of angled ribs 110 support the upper tread member 104 with respect to the base 95 and extend at an angle to the vertical axis 78 and an angle to the longitudinal axis 66. The angled ribs 110 are located closer to the back 64 than the front 62 and the vertical ribs 109 are located closer to the front 62 than the angled ribs 110. The spacing between the respective vertical and angled ribs 109, 110 varies along the length of the tread member 56 with respect to the longitudinal axis 66 and thus the size of the cross-bores 94 also varies.

The various embodiments disclosed herein show a changing contour of the tread member with respect to the longitudinal axis. In other examples it is contemplated to alternatively or also provide a contour with respect to the lateral axis, which further allows the foot to change angle as inversion or eversion if the pedals are moving in a lateral motion, such as on a lateral motion machine.

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. An exercise apparatus comprising a frame and first and second pedals that are coupled to the frame such that a user standing on the first and second pedals can perform a striding exercise, wherein the first and second pedals each have a tread member that extends longitudinally from front to back along a longitudinal axis, laterally from left side to right side along a lateral axis that is perpendicular to the longitudinal axis, and vertically from bottom to top along a vertical axis that is perpendicular to the longitudinal axis and perpendicular to the lateral axis, and wherein the tread member has a convex contoured upper tread surface when viewed with respect to a plane extending through the longitudinal and lateral axes; wherein the convex contoured upper tread surface supports an entire bottom of a user's foot in a manner that induces a rolling motion between the entire bottom of the user's foot and the tread member along the convex contoured upper tread surface during the striding exercise.

2. The exercise apparatus according to claim 1, wherein the convex contoured upper tread surface is symmetric with respect to the longitudinal axis.

3. The exercise apparatus according to claim 1, wherein the convex contoured upper tread surface is asymmetric with respect to the longitudinal axis.

4. The exercise apparatus according to claim 1, wherein the convex contoured upper tread surface follows a constant radius of curvature with respect to the longitudinal axis.

5. The exercise apparatus according to claim 1, further comprising a plurality of ribs that are adjacent to each other and are elongated with respect to the vertical axis, wherein the plurality of ribs forms the convex contoured upper tread surface.

6. The exercise apparatus according to claim 5, wherein the plurality of ribs vertically extends from a common base member that is planar with respect to the longitudinal and lateral axes.

7. The exercise apparatus according to claim 1, wherein the tread member has a uniform stiffness along the convex contoured upper tread surface such that the tread member provides a uniform resiliency to pressure from the bottom of the user's foot as the user's foot moves during the striding exercise.

8. The exercise apparatus according to claim 1, wherein the tread member has a varying stiffness along the convex contoured upper tread surface such that the tread member provides a non-uniform resiliency to pressure from the bottom of the user's foot as the user's foot moves during the striding exercise.

9. The exercise apparatus according to claim 8, wherein the tread member has a longitudinally forward section having a first stiffness that provides a first resiliency with respect to the pressure from the bottom of the user's foot, a longitudinally rearward section having a second stiffness that provides a second resiliency with respect to the pressure from bottom of the user's foot, and a middle section located between the longitudinally forward section and longitudinally rearward section, the middle section having a third stiffness that provides a third resiliency with respect to the pressure from the bottom of the user's foot, and wherein the third resiliency is less than at least one of the first and second resiliencies.

10. The exercise apparatus according to claim 9, wherein the first and second resiliencies are the same.

11. The exercise apparatus according to claim 9, wherein the forward section is formed from a first material providing the first resiliency, wherein the rearward section is formed from a second material providing the second resiliency, and wherein the middle section is formed of a third material providing the third resiliency, wherein the third material is different than the at least one of the first and second materials.

12. The exercise apparatus according to claim 9, further comprising a plurality of cross-bores formed in the tread member, wherein each cross-bore in the plurality of cross-bores has a size and shape that affects the resiliency of the tread member with respect to the pressure from the bottom of the user's foot at a location that is directly vertically above the respective cross-bore with respect to the vertical axis.

13. The exercise apparatus according to claim 12, wherein the plurality of cross-bores comprises a first set of cross-bores located in the forward section, a second set of cross-bores located in the rearward section, and a third set of cross-bores located in the middle section, wherein the third set of cross-bores and at least one of the first and second set of cross-bores have a different size compared to each other.

14. The exercise apparatus according to claim 12, wherein the plurality of cross-bores comprises a first set of cross-bores located in the longitudinally forward section, a second set of cross-bores located in the longitudinally rearward section, and a third set of cross-bores located in the middle section, wherein the third set of cross-bores and at least one of the first and second set of cross-bores have a different shape compared to each other.

15. The exercise apparatus according to claim 12, wherein the plurality of cross-bores laterally extend through the tread member.

16. The exercise apparatus according to claim 15, wherein the plurality of cross-bores comprises a first set of cross-bores that is elongated with respect to the vertical axis and a second set of cross-bores that is elongated with respect to the longitudinal axis.

17. The exercise apparatus according to claim 9, further comprising an upper tread member providing the contoured upper tread surface and a plurality of laterally-extending suspension tubes that support the upper tread member with respect to the pedal.

18. The exercise apparatus according to claim 17, wherein the plurality of laterally extending suspension tubes comprises forward and rearward suspension tubes and an intermediate suspension tube located between the forward and rearward suspension tubes, wherein the intermediate suspension tube provides a different resiliency to pressure from the user's foot than at least one of the forward and rearward suspension tubes.

19. The exercise apparatus according to claim 17, wherein the tread member further comprises a lower tread member, and wherein the plurality of laterally extending suspension tubes support the upper tread member with respect to the lower tread member.

20. The exercise apparatus according to claim 1, wherein the tread member comprises an upper tread member, a base, and a plurality of vertical ribs that support the upper tread member with respect to the base, and further comprising a plurality of cross-bores defined between the plurality of longitudinal ribs.

21. The exercise apparatus according to claim 20, further comprising a plurality of longitudinal ribs that longitudinally extend between vertical ribs in the plurality of vertical ribs, and further comprising a plurality of cross-bores defined between the plurality of longitudinal ribs.

22. The exercise apparatus according to claim 20, further comprising a plurality of angled ribs that support the upper tread member with respect to the base, wherein the plurality of angled ribs extends at an angle to the vertical axis and an angle to the longitudinal axis.

23. The exercise apparatus according to claim 1, further comprising a plurality of protrusions on the convex contoured upper tread surface, the plurality of protrusions providing tread for the bottom of the user's foot.

24. The exercise apparatus according to claim 23, wherein each protrusion in the plurality of protrusions extends laterally.

25. The exercise apparatus according to claim 1, wherein the pedal comprises a base housing and an insert that is supported on the base housing, wherein the insert provides the tread member.

26. The exercise apparatus according to claim 25, wherein the insert is coupled to the base housing.

27. The exercise apparatus according to claim 25, wherein the base housing comprises sidewalls that form an interior in which the insert is disposed.

28. An exercise apparatus comprising:

a frame; and first and second pedals that are pivotably coupled to the frame such that a user standing on the first and second pedals can perform a striding exercise;

wherein the first and second pedals each have a tread member that supports a bottom of a user's foot during the striding exercise, the tread member extending longitudinally from front to back along a longitudinal axis, laterally from left side to right side along a lateral axis that is perpendicular to the longitudinal axis, and vertically from bottom to top along a vertical axis that is perpendicular to the longitudinal axis and perpendicular to the lateral axis; and wherein the tread member has a contoured upper tread surface that is convex along the longitudinal axis and thus induces a rolling motion of an entire bottom of the user's foot along the contoured upper tread surface so that a change in angle occurs between the user's foot and a base of the pedal during the striding exercise.

29. The exercise apparatus according to claim 28, wherein the convex contoured upper tread surface is symmetric along the longitudinal axis.

30. The exercise apparatus according to claim 28, wherein the convex contoured upper tread surface is asymmetrical along the longitudinal axis.

31. The exercise apparatus according to claim 28, wherein the convex contoured upper tread surface follows a constant radius of curvature along the longitudinal axis.

32. The exercise apparatus according to claim 28, wherein the pedal comprises a base housing that provides the base of the pedal and an insert that is supported on the base housing, wherein the insert provides the tread member.

33. The exercise apparatus according to claim 32, wherein the insert is coupled to the base housing.

34. The exercise apparatus according to claim 33, wherein the base housing comprises sidewalls that form an interior in which the insert is disposed.

* * * * *